US007810903B2

(12) United States Patent
Kitahara et al.

(10) Patent No.: US 7,810,903 B2
(45) Date of Patent: Oct. 12, 2010

(54) HEAD UNIT, LIQUID DROPLET DISCHARGING APPARATUS, METHOD FOR DISCHARGING LIQUID, AND METHODS FOR MANUFACTURING COLOR FILTER, ORGANIC EL ELEMENT AND WIRING SUBSTRATE

(75) Inventors: Tsuyoshi Kitahara, Matsumoto (JP); Hirofumi Kobayashi, Shiojiri (JP)

(73) Assignee: Seiko Epson Corporation (JP)

( * ) Notice: Subject to any disclaimer, the term of this patent is extended or adjusted under 35 U.S.C. 154(b) by 430 days.

(21) Appl. No.: 11/872,232

(22) Filed: Oct. 15, 2007

(65) Prior Publication Data

US 2008/0100654 A1 May 1, 2008

(30) Foreign Application Priority Data

Oct. 16, 2006 (JP) ..... 2006-281140

(51) Int. Cl.
*B41J 2/205* (2006.01)

(52) U.S. Cl. ..... 347/43

(58) Field of Classification Search ..... 347/12, 347/13, 40, 43, 42, 14, 15
See application file for complete search history.

(56) References Cited

U.S. PATENT DOCUMENTS

| | | | | |
|---|---|---|---|---|
| 6,094,280 | A | 7/2000 | Hayasaki et al. | |
| 6,254,218 | B1 * | 7/2001 | Suzuki et al. | 347/43 |
| 6,660,332 | B2 | 12/2003 | Kawase et al. | |
| 6,893,103 | B2 | 5/2005 | Okada et al. | |
| 6,921,148 | B2 | 7/2005 | Nakamura et al. | |
| 6,939,407 | B2 | 9/2005 | Kawase et al. | |
| 7,384,126 | B2 | 6/2008 | Nakamura et al. | |
| 7,467,837 | B2 * | 12/2008 | Silverbrook | 347/13 |
| 2004/0100610 | A1 | 5/2004 | Kawase et al. | |
| 2005/0253884 | A1 | 11/2005 | Matsumoto et al. | |
| 2007/0216724 | A1 | 9/2007 | Shibata et al. | |

FOREIGN PATENT DOCUMENTS

| | | |
|---|---|---|
| EP | 1 475 233 | 11/2004 |
| EP | 1 642 727 | 4/2006 |
| JP | 2002-137374 | 5/2002 |
| JP | 2002-178488 | 6/2002 |
| JP | 2002-196127 | 7/2002 |
| JP | 2005-238821 | 9/2005 |
| JP | 2006-192892 | 7/2006 |
| KR | 2002-39614 | 5/2002 |
| KR | 2002-86864 | 11/2002 |
| KR | 2003-65347 | 8/2003 |
| KR | 2006-47348 | 5/2006 |

OTHER PUBLICATIONS

Search Report from European Patent Office dated Sep. 18, 2009.

* cited by examiner

*Primary Examiner*—Lamson D Nguyen
(74) *Attorney, Agent, or Firm*—Harness, Dickey & Pierce, P.L.C.

(57) ABSTRACT

A head unit includes a plurality of nozzle groups. Each group has a plurality of nozzles discharging liquid as liquid droplets. The nozzles are arranged at an approximately equal distance from one another when viewed from a first direction. The nozzle groups are arranged at the distance when viewed from the first direction and in a direction intersecting with the first direction, and adjacent nozzles of the nozzle groups adjacent when viewed from the first direction discharge an approximately equal amount of the liquid droplet.

19 Claims, 16 Drawing Sheets

HEAD UNIT, LIQUID DROPLET DISCHARGING APPARATUS, METHOD FOR DISCHARGING LIQUID, AND METHODS FOR MANUFACTURING COLOR FILTER, ORGANIC EL ELEMENT AND WIRING SUBSTRATE

RELATED APPLICATIONS

This application claims priority to Japanese Patent Application No. 2006-281140 filed Oct. 16, 2006 which is hereby expressly incorporated by reference herein in its entirety.

BACKGROUND

1. Technical Field

The present invention relates to a head unit including a nozzle group that discharges liquid, a liquid droplet discharging apparatus, a method for discharging liquid, and methods for manufacturing a color filter, an organic EL element and a wiring substrate.

2. Related Art

There are known a head unit with a nozzle group that discharges liquid and a liquid droplet discharging apparatus, in which a plurality of functional liquid discharging head units are intensively arranged such that the length of an array of the discharging heads in a main scanning direction is minimized (JP-A-2005-238821). In this case, main scanning means to discharge a functional liquid (liquid) during a relative movement between the functional liquid droplet discharging heads and an object on which droplets are discharged, and the main scanning direction means a direction of the relative movement therebetween.

In the above head unit, the functional liquid droplet discharging heads are juxtaposed so as to be displaced in the main scanning direction and in a sub scanning direction perpendicular therewith. Additionally, when viewed from the main scanning direction, nozzle sequences as nozzle groups, each including a plurality of nozzles discharging functional liquid droplets, are continuous with one another.

In the discharging head having the nozzle sequences, the amount of liquid discharged varies among the nozzles. In order to reduce the variation, there is known an inkjet recording apparatus that can equalize the discharging amount among the nozzles by driving discharging heads with nozzle sequences divided into a plurality of groups (JP-A-2002-196127).

JP-A-2005-238821 is a first example of related art.

JP-A-2002-196127 is a second example of related art.

FIGS. 18A and 18B each show a relationship between the arrangement of discharging heads and the discharging amount in a known method for discharging liquid. FIG. 18A shows the discharging amount varying among the discharging heads and FIG. 18B shows the discharging amount varying within the nozzle sequences of the discharging heads. More specifically, the drawings show the amounts of liquid discharged on the same drawing region in accordance with a drawing width of each of the discharging heads 1, 2 during a period of time in which a workpiece is moved relatively with the discharging heads 1, 2 four times in the main scanning direction. Regarding each of the discharging heads 1, 2, the nozzle sequences are divided into four groups and the discharging amounts of each group are temporarily digitized.

As shown in FIG. 18A, for example, in the head unit of the first example of related art, when the discharging amount varies between the discharging heads 1 and 2, there occurs a difference between the discharging amounts depending on the arrangement of the discharging heads 1 and 2 (in FIG. 18A, the discharging amount of the heads is 4.04 versus 4.16).

Additionally, as shown in FIG. 18B, for example, when there is an inclination in the distribution of the discharging amount of each group of nozzle sequences (in FIG. 18, the discharging amount varies from 1.01 to 1.04), a nozzle sequence group of one of the heads 1 and 2 discharges a maximum amount at a boundary between the discharging heads 1 and 2, whereas a nozzle sequence group of the other head discharges a minimum amount. Consequently, as compared to the case shown in FIG. 18A, liquid is discharged more unevenly.

The above variation of the discharging amounts across the discharging heads 1 and 2 results in noticeable uneven discharging distribution, particularly, at both ends of the nozzle sequences.

If the nozzle sequences are divided into a plurality of groups to drive the discharging heads to ward against the above defect, the driving mechanism becomes more complicated as the number of the discharging heads increases.

SUMMARY

Therefore, the present invention has been provided in view of the above problems. An advantage of at least one aspect of the invention is to provide a head unit capable of reducing the uneven discharging distribution of liquid due to the discharging amount variation of each nozzle group, a liquid droplet discharging apparatus including the head unit, a method for discharging liquid, and methods for manufacturing a color filter, an organic EL element and a wiring substrate.

A head unit according to a first aspect of the invention includes a plurality of nozzle groups, each group having a plurality of nozzles that discharge liquid as a liquid droplet and are arranged at an approximately equal distance when viewed from a first direction, the nozzle groups being arranged at the distance when viewed from the first direction and in a direction intersecting with the first direction, and adjacent nozzles of the nozzle groups adjacent when viewed from the first direction discharging an approximately equal amount of the liquid droplet.

In the above structure, the plurality of nozzle groups are arranged in such a manner that the amount of a liquid droplet discharged from each of the adjacent nozzles of the nozzle groups adjacent when viewed from the first direction is approximately equal. Accordingly, there is little difference between the amounts of discharging at a boundary between the adjacent nozzle groups. Therefore, although the nozzle groups are arranged in the direction intersecting with the first direction, the head unit according to the first aspect can reduce the uneven distribution of discharged liquid due to variation of the discharging amount of each nozzle group. In this case, the adjacent nozzles represent at least two nozzles adjacent at the boundary between the adjacent nozzle groups. Additionally, each of the nozzle groups is not restricted to a group including a plurality of linearly arranged nozzles and may include a plurality of staggeringly arranged nozzles.

Preferably, the nozzle groups have an inclination when a distribution of the discharging amount is represented by a first-order approximation formula in a graph with one axis representing nozzle arrangements and the other representing amounts of the liquid droplet discharged from the nozzles and are arranged such that the adjacent nozzle groups are different in an angle of the inclination.

In the above structure, the nozzle groups are arranged such that the distributions of the discharging amounts of the adjacent nozzle groups show a different inclination. Accordingly, the discharging amounts thereof vary not sharply but moderately at the boundary between the adjacent nozzle groups, so that the uneven distribution of discharged liquid is less noticeable.

In addition, preferably, the nozzle groups are arranged such that the adjacent nozzle groups are mutually opposite (positive or negative) in a direction of the inclination. In this manner, the adjacent nozzle groups are mutually opposite (positive or negative) in the direction of the inclination of the distribution of the discharging amount. Accordingly, discharging liquid by displacing the head unit in the direction intersecting with the first direction allows the inclinations in the distribution of the discharging amounts of the adjacent nozzle groups to be mutually canceled. In short, the liquid discharging distribution can be more equalized.

In addition, preferably, the nozzle groups are arranged such that the inclinations of the adjacent nozzle groups are axisymmetrical when viewed from the first direction. In this manner, discharging the liquid by displacing the head unit in the direction intersecting with the first direction allows the discharging amount distribution of the liquid to be further equalized.

In addition, preferably, the nozzle groups are juxtaposed on the head unit in the first direction. In this manner, since each of the nozzle groups is juxtaposed thereon in the first direction, the discharging amount variation of each nozzle group can be dispersed by the plurality of nozzle groups to apply liquid, whereby the uneven discharging distribution of liquid due to the discharging amount variation can be less noticeable.

A liquid droplet discharging apparatus according to a second aspect of the invention includes a head unit including a plurality of nozzle groups, each group having a plurality of nozzles arranged at an approximately equal distance when viewed from a main scanning direction, the nozzle groups being arranged at the distance when viewed from the main scanning direction and in a direction intersecting with the main scanning direction, adjacent nozzles of the nozzle groups adjacent when viewed from the main scanning direction discharging an approximately equal amount of a liquid droplet; and a workpiece arranged in opposite to the head unit and moved relatively with the head unit to perform main scanning, the each nozzle group discharging liquid as the liquid droplet in synch with the main scanning.

In the above structure, the discharging amount is approximately equal between the adjacent nozzles of the nozzle groups adjacent when viewed from the main scanning direction. Thus, when liquid is discharged in synch with the main scanning, it is unlikely that the uneven distribution of discharged liquid occurs due to a difference in the discharging amounts at the boundary between the adjacent nozzle groups. Accordingly, the liquid droplet discharging apparatus according to the second aspect can reduce the uneven distribution of discharged liquid resulting from a varied discharging amount of each nozzle group.

In addition, preferably, the nozzle groups have an inclination when a distribution of the discharging amount is represented by a first-order approximation formula in a graph with one axis representing nozzle arrangements and the other representing amounts of the liquid droplet discharged from the nozzles and are arranged on the head unit such that the adjacent nozzle groups are different in an angle of the inclination. In this manner, the discharging amounts vary not sharply but moderately at the boundary between the nozzle groups. Therefore, the liquid droplet discharging apparatus according to the second aspect allows the uneven distribution of discharged liquid to be more unnoticeable.

In addition, preferably, the nozzle groups are arranged on the head unit such that the adjacent nozzle groups are mutually opposite (positive or negative) in a direction of the inclination. In this manner, between the adjacent nozzle groups, the inclination direction of the discharging amount is different (positive or negative). Thus, by displacing the head unit in the intersecting direction, liquid can be discharged so as to mutually cancel the inclinations in the discharging amount distributions of the groups. In short, the discharging distribution of liquid can be equalized.

In addition, preferably, the nozzle groups are arranged on the head unit such that the inclinations of the adjacent nozzle groups are axisymmetrical when viewed from the main scanning direction. In this manner, discharging liquid by displacing the head unit in the intersecting direction allows further equalization of the discharging distribution of the liquid.

Furthermore, preferably, the nozzle groups are juxtaposed on the head unit in the main scanning direction. In this manner, by arranging the nozzle groups as above, the variation of the discharging amount of each nozzle group can be dispersed by the plurality of nozzle groups in the main scanning direction to apply the liquid. Thus, the uneven liquid distribution due to the discharging amount variation can be less noticeable. In other words, by using the liquid droplet discharging apparatus according to the second aspect, liquid can be more evenly applied in an intended drawing region of the workpiece.

According to a third aspect of the invention, a method for discharging liquid includes preparing a head unit including a plurality of nozzle groups, each group having a plurality of nozzles arranged at an approximately equal distance when viewed from a main scanning direction, the nozzle groups being arranged at the distance when viewed from the main scanning direction and in a direction intersecting with the main scanning direction, and adjacent nozzles of the nozzle groups adjacent when viewed from the main scanning direction discharging an approximately equal amount of a liquid droplet; arranging a workpiece in a position opposite to the head unit to move relatively with the head unit so as to perform main scanning; and discharging liquid as the liquid droplet from each of the nozzle groups in synch with the main scanning that is performed "n"-number of times in a same drawing region of the workpiece, in which, relative to a prior main scanning, a subsequent main scanning is performed by moving the head unit relatively with the workpiece in such a manner that the nozzle groups are displaced in the intersecting direction by a length of 1/n of a valid length of the nozzle groups when viewed from the main scanning direction to discharge the liquid droplet therefrom.

The above method employs the liquid droplet discharging apparatus with the head unit that can reduce the uneven distribution of discharged liquid due to the discharging amount variation of each nozzle group. At the discharging process, liquid droplets are discharged from the nozzle sequences through the "n"-number of times of main scanning operations on the same drawing region of the workpiece. Then, in the "n"-number of times of main scanning operations, relative to the arrangement of the nozzle groups in a prior main scanning, in the case of a subsequent main scanning, the nozzle groups are displaced in the direction intersecting with the main scanning direction by the length of 1/n of the valid length of the nozzle groups when viewed from the main scanning direction. Thereby, after a first main scanning, at every main scanning, liquid droplet is applied in the same drawing region by displacing the nozzle groups by the length of 1/n of the valid length thereof in the above intersecting direction. Accordingly, at the liquid discharging operation, the nozzle groups are substantially divided into "n"-number of groups, and at every main scanning, liquid droplets are discharged in the same drawing region by displacing the nozzle groups by a single group. In other words, in the liquid discharging method according to the third aspect, the discharging amount variation of each nozzle group can be dispersed through the "n"-number of times of main scanning, so that liquid can be applied more evenly.

In the above method, preferably, at the time of the discharging, the head unit is moved relatively with the workpiece in such a manner that, relative to one of the adjacent nozzle groups in a prior main scanning, the other one thereof is displaced in the intersecting direction by the length of 1/n of the valid length of the nozzle groups when viewed from the main scanning direction to perform a subsequent main scanning.

The above method can reduce main scanning for applying liquid droplets continuously from the same nozzle group in the same drawing region. Accordingly, the discharging amount variation of each nozzle group can be further dispersed.

In addition, preferably, at the time of the discharging, in at least one time out of the "n"-number of times of the main scanning operations, the head unit is moved relatively with the workpiece in such a manner that, relative to the prior main scanning, each nozzle group is displaced in the intersecting direction by a length of ½ of the valid length of the nozzle groups when viewed from the main scanning direction. In this manner, the main scanning performed by regularly displacing the nozzle groups by the 1/n of the valid length is combined with the main scanning performed by regularly displacing them by the ½ thereof, whereby dispersibility of the discharging amount variation can be changed.

According to a fourth aspect of the invention, a method for discharging liquid includes preparing a head unit including a plurality of nozzle groups, each having a plurality of nozzles arranged at an approximately equal distance when viewed from a main scanning direction, the nozzle groups being arranged at the distance when viewed from the main scanning direction and in a direction intersecting with the main scanning direction, and adjacent nozzles of the nozzle groups adjacent when viewed from the main scanning direction discharging an approximately equal amount of a liquid droplet; arranging a workpiece in a position opposite to the head unit to move relatively with the head unit so as to perform main scanning; and discharging liquid as the liquid droplet from each of the nozzle groups in synch with the main scanning that is performed "n"-number of times in a same drawing region of the workpiece, in which, relative to a prior main scanning, a subsequent main scanning is performed by moving the head unit relatively with the workpiece in such a manner that the nozzle groups are displaced in the intersecting direction by a length of ½ of a valid length of the nozzle groups when viewed from the main scanning direction to discharge the liquid droplet therefrom.

The above method employs the liquid droplet discharging apparatus with the head unit that can reduce the uneven liquid distribution due to the discharging amount variation of each nozzle group. At the discharging operation, a liquid droplet is discharged from each nozzle group by performing the "n"-number of times of main scanning operations in the same drawing region of the workpiece. Then, in the "n"-number of times of main scanning operations, relative to the arrangement of the nozzle groups in a prior main scanning, in a subsequent main scanning, each nozzle group is displaced in the direction intersecting with the main scanning direction by the length of ½ of the valid length of the nozzle groups when viewed from the main scanning direction. Thereby, after a first main scanning, at every main scanning, a liquid droplet is applied in the same drawing region by displacing the nozzle groups by the length of ½ of the valid length in the direction intersecting with the main scanning direction. Accordingly, the nozzle groups are divided into substantially two groups and a liquid droplet is applied in the same drawing region from a different one of the nozzle groups at every main scanning. In other words, in the discharging method according to the fourth aspect, the discharging amount variation of each nozzle group can be equalized through the "n" number of times of main scanning operations, so that liquid can be applied more evenly.

In addition, preferably, at the time of the discharging, the head unit is moved relatively with the workpiece in such a manner that, relative to one of the adjacent nozzle groups in the prior main scanning, the other one thereof is displaced in the intersecting direction by the length of ½ of the valid length of the nozzle groups when viewed from the main scanning direction. This can reduce main scanning for applying a liquid droplet in the same drawing region continuously from the same nozzle group. Accordingly, the discharging amount variation of each nozzle group can be further dispersed.

In the liquid discharging method according to the third or the fourth aspect, preferably, the nozzle groups have an inclination when a distribution of the discharging amount is represented by a first-order approximation formula in a graph with one axis representing nozzle arrangements and the other representing amounts of the liquid droplet discharged from the nozzles and are arranged on the head unit such that the adjacent nozzle groups are different in an angle of the inclination. In this manner, the discharging amounts vary not sharply but moderately at the boundary between the nozzle groups. Thus, the discharging method employs the head unit that can reduce the uneven distribution of discharged liquid. Consequently, the discharging amount variation of each nozzle group can be suppressed and dispersed. In short, when liquid is applied, the uneven discharging distribution can be further reduced.

In the above method, preferably, the nozzle groups are arranged on the head unit such that the adjacent nozzle groups are mutually opposite (positive or negative) in a direction of the inclination. In this manner, by moving the head unit in a sub scanning direction, liquid can be discharged such that positive and negative values of the inclinations in the discharging amount distributions of the adjacent nozzle groups are mutually cancelled. Therefore, the discharging amount variation of each nozzle group can be further suppressed and dispersed.

In the above method, preferably, the nozzle groups are arranged on the head unit such that the inclinations of the adjacent nozzle groups are axisymmetrical when viewed from the main scanning direction. In this manner, discharging liquid by displacing the head unit in the intersecting direction allows the discharging distribution of the liquid to be more equalized.

In the above method, preferably, the nozzle groups are juxtaposed on the head unit in the main scanning direction. In this manner, by arranging the nozzle groups as described above, the discharging amount variation of each nozzle group can be dispersed by the plurality of nozzle groups in the main scanning direction to apply liquid, thereby allowing the uneven liquid distribution due to the discharging amount variation to be less noticeable. In other words, by using the above liquid discharging method, liquid can be more evenly applied in an intended drawing region of the workpiece.

According to a fifth aspect of the invention, there is provided a method for manufacturing a color filter having colored layers of at least three colors. The method includes partitioning and forming a plurality of colored regions on a substrate; discharging/drawing liquids of the at least three colors as liquid droplets in the colored regions by using the liquid discharging method according to the third or the fourth aspect, the liquid including a colored-layer forming material; and drying the discharged/drawn liquids to form the colored layers of the at least three colors.

In this method, at the time of the drawing, the liquids of at least three colors are discharged/drawn by the discharging method according to the third or the fourth aspect allowing more even application of liquid. Thereafter, at the time of the drying process, the discharged/drawn liquids are dried, whereby there can be obtained a color filter that has the colored layers with less uneven coloring due to uneven liquid discharging distribution.

According to a sixth aspect of the invention, there is provided a method for manufacturing an organic EL element having an organic EL light-emitting layer in each of plurality of light-emitting layer formation regions. The method includes partitioning and forming a plurality of light-emitting layer formation regions on a substrate; discharging/drawing liquid as a liquid droplet in the each region by using the discharging method according to the third or the fourth aspect, the liquid including at least a light-emitting layer forming material; and drying the discharged/drawn liquid to form the organic EL light-emitting layer.

In this method, at the time of the drawing, the liquid including the light-emitting layer forming material is discharged/drawn by the discharging method according to the third or the fourth aspect allowing more even liquid application. Thereafter, by drying the discharged/drawn liquid at the time of the drying process, there can be obtained an organic EL element having the organic EL light-emitting layers with less variations of light-emission and luminance caused by the uneven discharging distribution.

According to a seventh aspect of the invention, a method for manufacturing a wiring substrate includes discharging/drawing liquid as a liquid droplet on the substrate, the liquid including the conductive material; and drying and burning the discharged/drawn liquid to form a wire made of the conductive material.

In the above method, at the time of the drawing, the liquid including the conductive material is discharged/drawn by the discharging method according to the third or the fourth aspect allowing more even liquid application. Thereafter, at the drying and burning process, the discharged/drawn liquid is dried and burned, whereby there can be obtained a wiring substrate with a wire having less variations in a film thickness and electric resistance resulting from the uneven liquid discharging distribution.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described in detail regarding a head unit including a plurality of discharging heads that can discharge liquid as liquid droplets, a liquid droplet discharging apparatus including the head unit, a method for discharging liquid using the apparatus, and methods for manufacturing a color filter, an organic EL element, and a wiring substrate. The drawings referred to in the following description are scaled up or down as necessary to ease understanding.

First Embodiment

Liquid Droplet Discharging Apparatus

Figure 1:
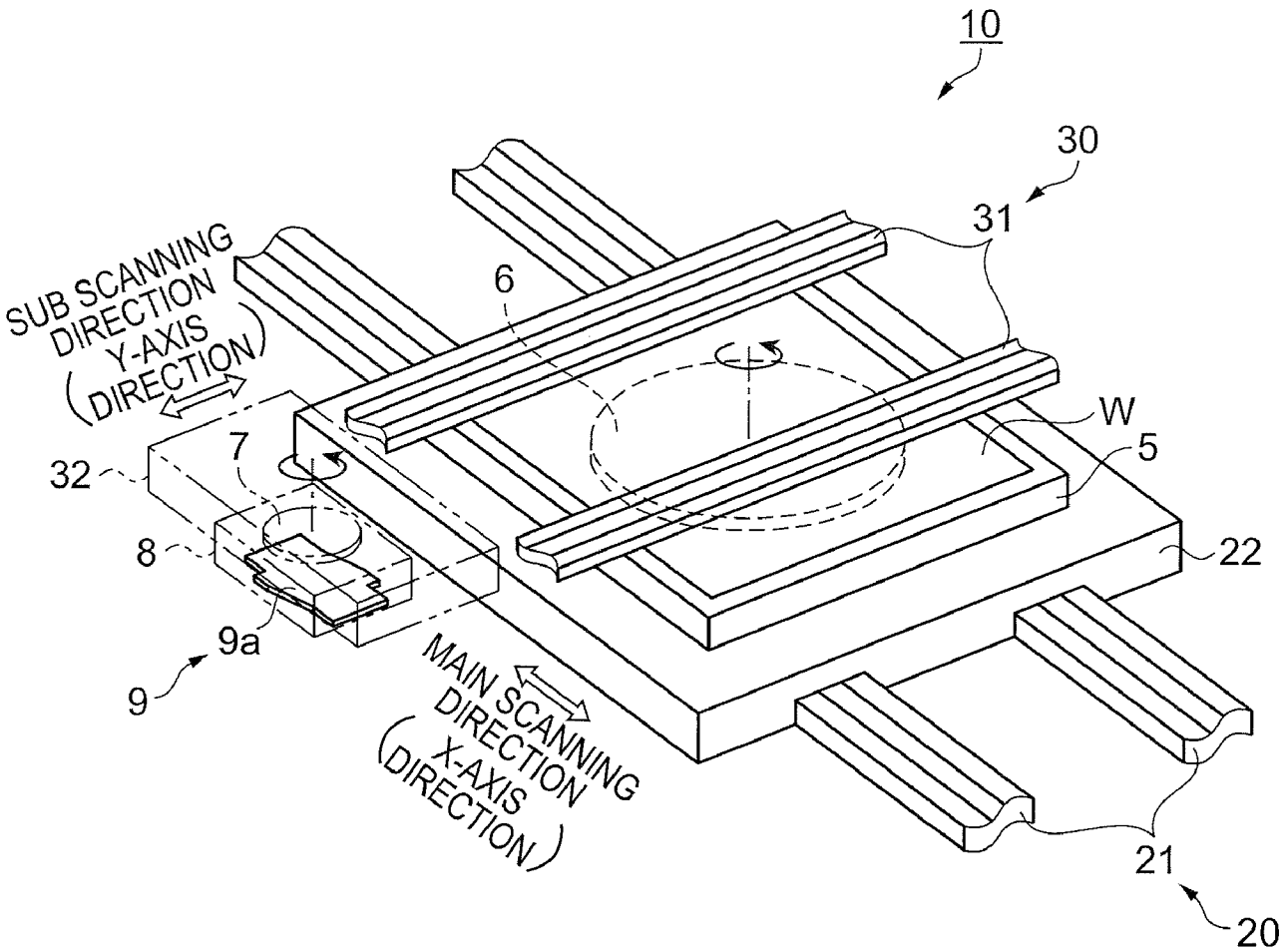
FIG. 1 is a schematic perspective view showing a structure of a liquid droplet discharging apparatus according to a first embodiment of the invention.

First, a description will be given of a liquid droplet discharging apparatus according to a first embodiment of the invention. FIG. 1 is a schematic perspective view showing a structure of the liquid droplet discharging apparatus.

As shown in FIG. 1, a liquid droplet discharging apparatus 10 of the present embodiment includes a workpiece moving mechanism 20 for moving a workpiece W in a main scanning direction (X-axis direction) and a head moving mechanism 30 for moving a liquid droplet discharging head 50 as a discharging head (See FIG. 2) in a sub scanning direction (Y-axis direction).

The workpiece moving mechanism 20 includes a pair of guide rails 21, a moving board 22 moving along the pair of guide rails 21, and a set table 5 for placing the workpiece W disposed on the moving board 22 via a θ table 6 as a rotation mechanism. The moving board 22 is moved by an air slider and a linear motor (which are not shown), disposed inside the guide rails 21 in the main scanning direction. The set table 5 can apply suction to and fix the workpiece W thereto, and the θ table 6 allows a reference axis inside the workpiece W to be adjusted appropriately in the main scanning direction and the sub scanning direction.

The head moving mechanism 30 includes a pair of guide rails 31 and a moving board 32 moving along the pair of guide rails 31. The moving board 32 has a carriage 8 suspended by a rotation mechanism 7 positioned therebetween. The carriage 8 includes a head unit 9 according to one of embodiments of the invention. The head unit 9 has a plurality of liquid droplet discharging heads 50 mounted thereon. Additionally, the carriage 8 further includes a liquid supply mechanism (not shown) for supplying liquid to the liquid droplet discharging heads 50 and a control circuit substrate (not shown) for performing an electrical drive control of the liquid droplet discharging heads 50. The moving board 32 moves the carriage 8 in the Y-axis direction such that the head unit 9 is arranged in a position opposed to the workpiece W.

In addition to the above features, the liquid droplet discharging apparatus 10 includes a maintenance mechanism for performing maintenance tasks such as eliminating nozzle clogging of the liquid droplet discharging heads 50 mounted on the head unit 9 and removing foreign substances and stains on nozzle surfaces. The maintenance mechanism is arranged in a position facing the liquid droplet discharging heads 50, although not shown in the drawing.

Figure 2A:
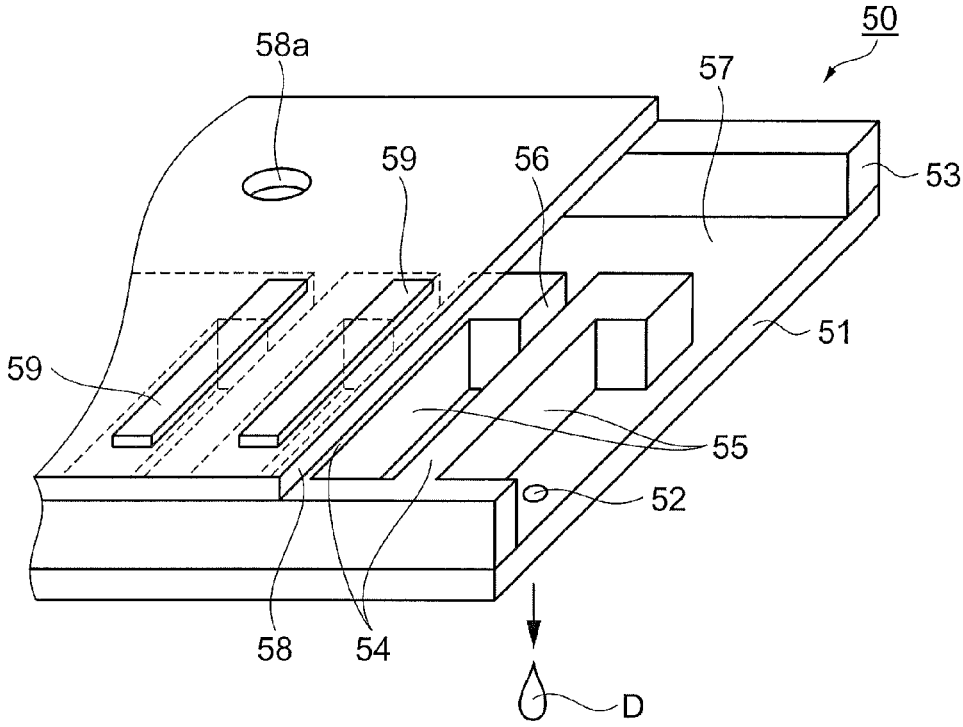
FIG. 2A is a schematic exploded perspective view showing a structure of a liquid droplet discharging head.
Figure 2B:
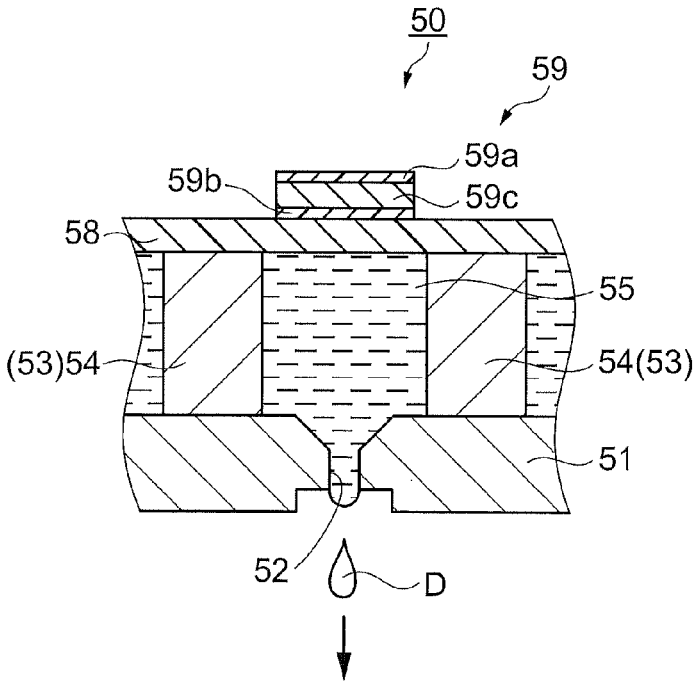
FIG. 2B is a sectional view showing a structure of a nozzle section.

FIGS. 2A and 2B are schematic views showing a structure of a liquid droplet discharging head. FIG. 2A is a schematic enlarged perspective view and FIG. 2B is a sectional view showing a structure of a nozzle section. As shown in FIGS. 2A and 2B, the liquid droplet discharging head 50 is constructed by sequentially laminating and bonding a nozzle plate 51 having a plurality of nozzles 52 discharging liquid droplets D, a cavity plate 53 having a partition wall 54 partitioning a cavity 55 that communicates with each of the nozzles 52, and a vibration plate 58 having a resonator 59 corresponding to each of the cavities 55.

The partition wall 54 of the cavity plate 53 partitions each cavity 55 communicating with a nozzle 52 to define flow paths 56, 57 for filling each cavity 55 with liquid. The flow path 57 is sandwiched by the nozzle plate 51 and the vibration plate 58, whereby there is formed a space serving as a reservoir for reserving the liquid.

The liquid is supplied from the liquid supply mechanism through piping to be reserved in the reservoir through a supply hole 58*a* formed in the vibration plate 58 and then is filled in each cavity 55 through the flow path 56.

As shown in FIG. 2B, the resonator 59 is a piezoelectric element that is comprised of a piezo element 59*c* and a pair of electrodes 59*a*, 59*b* sandwiching the piezo element 59*c* therebetween. A driving voltage pulse is applied to the pair of electrodes 59*a*, 59*b* from an outside source to deform the bonded vibration plate 58. Consequently, a volume of the cavity 55 partitioned by the partition wall 54 is increased and thereby the liquid is drawn into the cavity 55 from the reservoir. Then, after the application of the driving voltage pulse, the vibration plate 58 returns to its original shape and pressurizes the liquid. As a result, the liquid can be discharged as the liquid droplet D from each nozzle 52. Controlling the driving voltage pulse applied to the piezo element 59*c* allows control of the liquid discharging of each nozzle 52.

The liquid droplet discharging head 50 is not restricted to a discharging head including a piezoelectric element (piezo element). Rather, it may include an electromechanical conversion element causing the vibration plate 58 to be displaced by electrostatic adhesion or an electrothermal conversion element heating the liquid to discharge it as the liquid droplet D from each nozzle 52.

Figure 3:
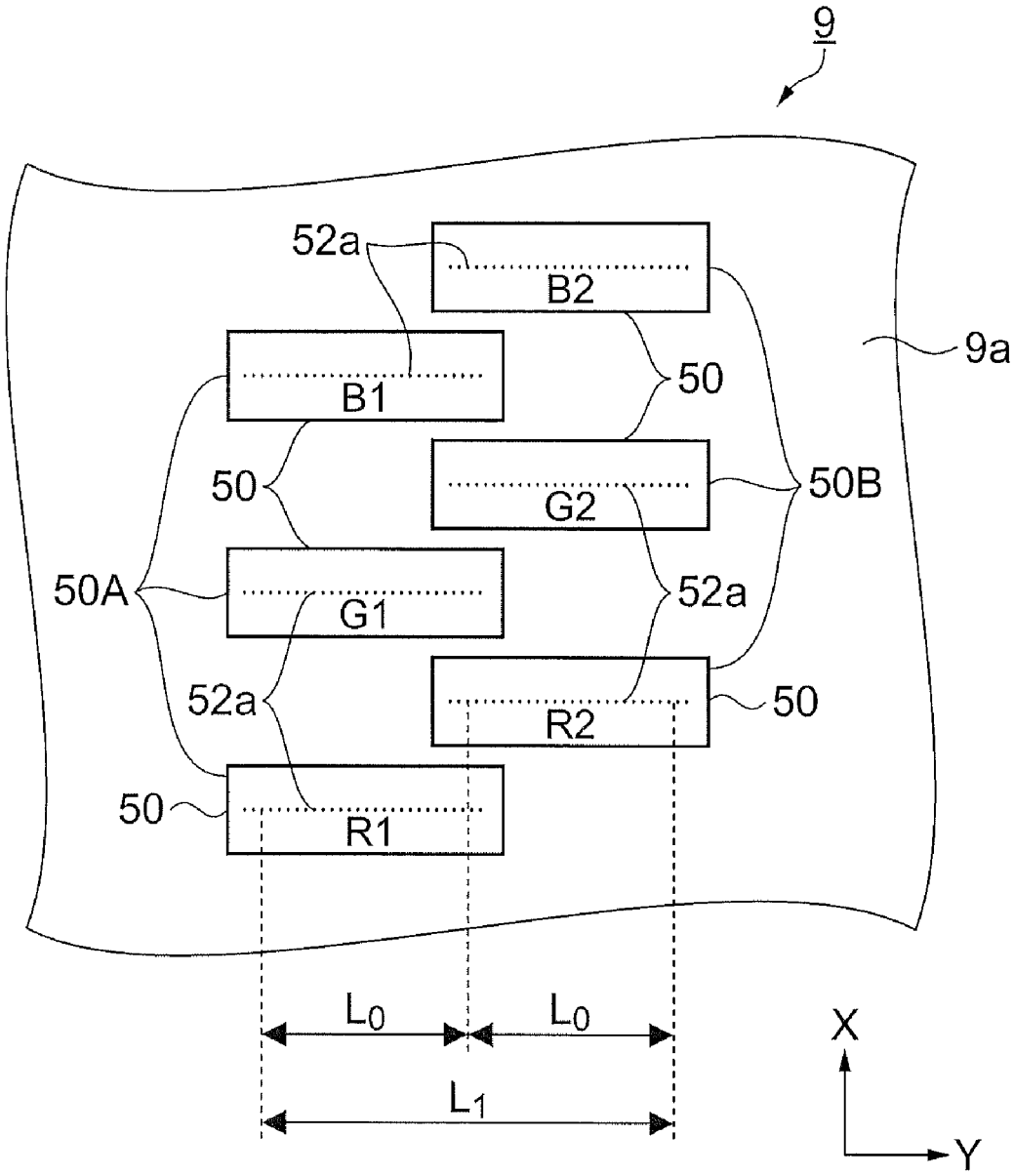
FIG. 3 is a plan view showing an arrangement of the liquid droplet discharging heads in a head unit.

FIG. 3 is a plan view showing an arrangement of the liquid droplet discharging heads in the head unit. Specifically, FIG. 3 is a view from a side opposite to the workpiece W.

As shown in FIG. 3, the head unit 9 includes a head plate 9*a* having the liquid droplet discharging heads 50 disposed thereon. On the head plate 9*a*, there are provided a total of six of the liquid droplet discharging heads 50, which includes a head group 50A comprised of three of the liquid droplet discharging heads 50 and a head group 50B similarly comprised of three of the liquid droplet discharging heads 50. In this case, a head R1 (liquid droplet discharging head 50) of the head group 50A discharges the same kind of liquid as that discharged from a head R2 (liquid droplet discharging head 50) of the head group 50B. The other heads G1, G2 and B1, B2, respectively, are also the same as above. In short, the head unit 9 is constituted to discharge three different kinds of liquids.

Each of the liquid droplet discharging heads 50 includes a nozzle sequence 52*a* as a nozzle group that is comprised of a plurality (180) of nozzles 52 arranged at an equal distance from one another (a nozzle pitch of approximately 140 μm). Each nozzle 52 has a diameter of approximately 20 μm. The amount of liquid discharged from each ten (10) nozzles 52 positioned at each end side of the nozzle sequence 52*a* varies more easily than that of liquid discharged from the other nozzles 52. Thus, one hundred and sixty (160) nozzles 52 excluding the each ten (10) nozzles 52 are used as valid nozzles. Accordingly, a drawing width that allows a single liquid droplet discharging head 50 to discharge/draw is referred to as $L_0$, which is set as a valid length of the nozzle sequence 52*a*. Hereinafter, the nozzle sequence 52*a* will be referred to as a sequence comprised of the valid 160 nozzles 52.

In this case, the heads R1 and R2 are juxtaposed in the main scanning direction in such a manner that the nozzle sequences 52*a* that are adjacent to one another when viewed from the main scanning direction (X-axis direction) are continuous with a single, consistent nozzle pitch therebetween in the sub scanning direction (Y-axis direction) orthogonal to the main scanning direction. In other words, the head R2 is positioned next to the head R1 such that a nozzle pitch is consistent from the nozzle sequence 52*a* on head R1 to the nozzle sequence 52*a* on head R2. Further, the nozzle sequence 52*a* on head R2 laterally overlaps the nozzle sequence 52*a* on head R1 so that the valid 160 nozzles on head R2 run consecutively with the valid 160 nozzles on head R1. Consequently, a valid drawing width $L_1$ of the heads R1, R2 discharging the same kind of liquid is twice the drawing width $L_0$. The heads G1, G2, and B1, B2, respectively, are similarly juxtaposed in the main scanning direction.

Figure 4A:
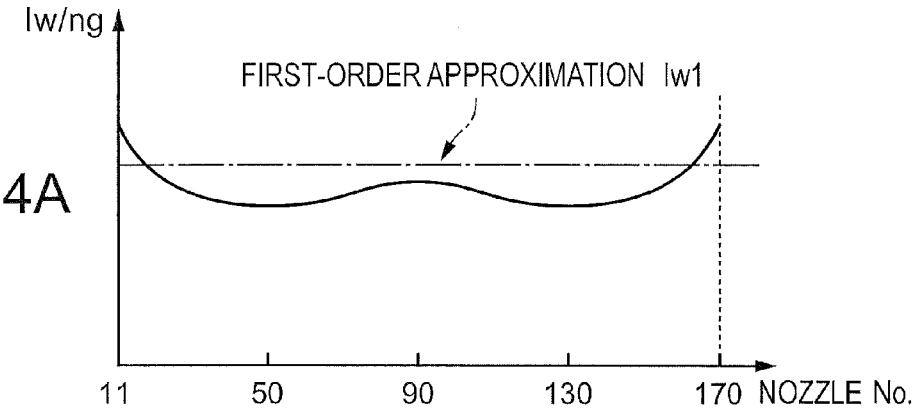
FIGS. 4A to 4C are graphs showing discharging characteristics of the liquid droplet discharging apparatus.
Figure 4B:
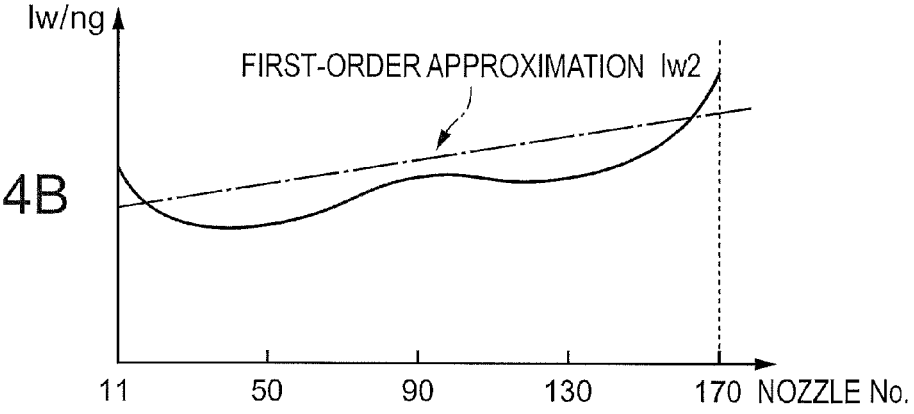
Figure 4C:
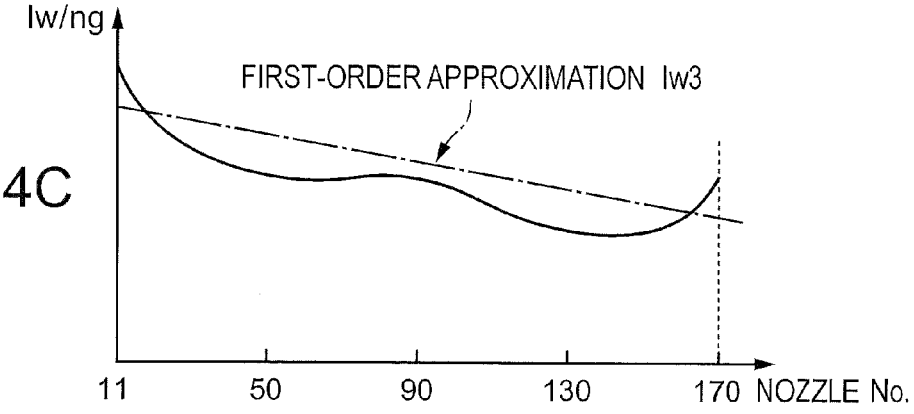

FIGS. 4A to 4C are graphs showing discharging characteristics of the liquid droplet discharging head 50. Specifically, one of the axes represents the numbers of valid nozzles and the other axis represents the amounts (Iw/ng) of liquid droplets discharged from each nozzle 52, thereby each showing a distribution of the discharging amount of the nozzle sequence 52*a*.

As already shown in FIGS. 2A and 2B, the amounts (e.g., weight or volume) of the liquid droplets discharged from the plurality of nozzles 52 may vary among the nozzles, because a flow resistance of the liquid flowing in each cavity 55 varies with the designed dimensions and processing precision of the cavities 55 and the flow paths 56, 57. Additionally, the discharging amounts thereof are influenced by the location of the supply hole 58*a* through which liquid is supplied relative to the cavities 55, and also by the inherent vibration characteristics of the resonator 59 disposed in each cavity 55. That is, the distribution of the amount of liquid droplets discharged from the nozzle sequence 52*a* can vary with the liquid droplet discharging heads 50. FIGS. 4A to 4C show discharging characteristics obtained by using the manufactured liquid droplet discharging heads 50. Specifically, a driving waveform having a predetermined driving voltage is applied to the resonator 59 to allow the nozzles 52 to discharge the amount of liquid droplets equivalent to the number of times of discharging ranging approximately from a few thousand to ten thousand times so as to measure the weights of the discharged liquid droplets. Next, the measured weights thereof were divided by the above number of times of discharging to obtain a weight per droplet as the amount of the liquid droplet discharged.

As shown in FIGS. 4A to 4C, one of the discharging characteristics represents a curving shape, which is called "Iw arch", where the amount of liquid droplets discharged from the nozzles 52 positioned at each end side of the nozzle sequence 52*a* (valid nozzles) is inclined to increase as compared to those discharged from the other nozzles 52. Then, when the above curve is linearized by a first-order approximation, the obtained lines are roughly classified into any one of a straight line Iw1 with almost no inclination as shown in FIG. 4A, a straight line Iw2 with a positive inclination as shown in FIG. 4B, or a straight line Iw3 with a negative inclination as shown in FIG. 4C.

In the head unit 9 according to the present embodiment, in consideration of the above discharging characteristics, each liquid droplet discharging head 50 is arranged on the head plate 9*a* in such a manner that the uneven distribution of discharged liquid due to the varied discharging amount of each discharging head 50 can be minimized.

In the present embodiment, regarding the arrangement of the liquid droplet discharging heads 50 discharging the same kinds of liquid, since the nozzle sequence 52*a* has the inclination of distribution of the discharging amount, the liquid droplet discharging heads 50 are selected such that the inclinations are approximately axisymmetrical with respect to a boundary between the two continuing nozzle sequences 52*a* as an axis of symmetry. That is, the discharging heads are selected such that the discharging amounts (Iw/ng) of adjacent nozzles are approximately equal at the boundary of the nozzle groups which are adjacent when viewed from the main scanning direction (X-axis direction) and also the above inclinations are opposite (positive or negative) to each other.

Figure 5:
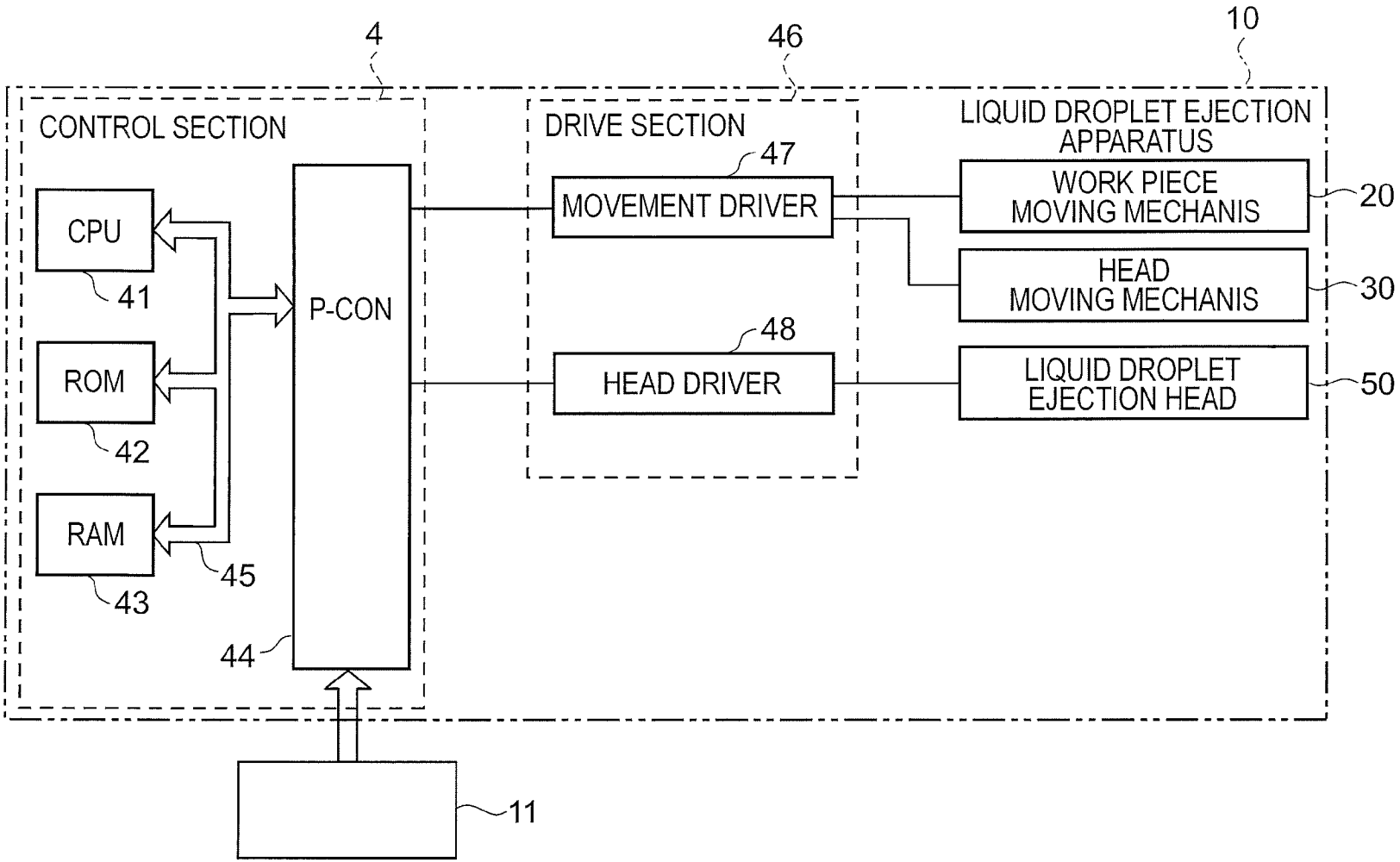
FIG. 5 is a block diagram showing a control system of the liquid droplet discharging apparatus.

Next, a description will be given of a control system of the liquid droplet discharging apparatus 10. FIG. 5 is a block diagram showing the control system thereof, which includes a host computer 11, a drive section 46 having drivers for driving the liquid droplet discharging heads 50, the workpiece moving mechanism 20, the head moving mechanism 30 and the like, and a control section 4 performing the centralized control of the entire liquid droplet discharging apparatus 10 including the drive unit 46.

The drive section 46 includes a moving driver 47 performing the drive-control of each linear motor of the workpiece moving mechanism 20 and the head moving mechanism 30, a head driver 48 performing the discharging control of the liquid droplet discharging heads 50 and a maintenance driver (not shown) performing the drive-control of each maintenance unit of the maintenance mechanism.

The control section 4 includes a CPU 41, a ROM 42, a RAM 43 and a P-CON 44, which are connected to one another by a bus 45. The ROM 42 has a control program region for storing a control program and the like processed by the CPU 41 and a control data region for storing control data and the like used to perform drawing operations, function recovery processing and the like.

The RAM 43 has various storage sections such as a drawing-data storage section for storing drawing data used to perform drawing operations on the workpiece W and a positional-data storage section for storing positional data of the workpiece W and the liquid droplet discharging heads 50, thereby serving as a region for various tasks performed for control processing. The P-CON 44 is connected to the drivers and the like of the drive section 46 to cover the functions of the CPU 41. Additionally, the P-CON 44 has a logic circuit formed and incorporated therein to handle interface signals between the CPU and a peripheral circuit. Thus, the P-CON 44 receives commands or the like from the host computer 11 and forwards them to the bus 45 either without processing or after processing. Additionally, the P-CON 44 works together with the CPU 41 to allow data or control signals sent to the bus 45 from the CPU 41 or the like to be output to the driver section 46 either without being processed or after being processed.

Then, according to the control program stored in the ROM 42, the CPU 41 inputs detection signals, commands, data or the like by the P-CON 44 to perform processing of various data or the like stored in the RAM 43, and thereafter, outputs various control signals to the drive section 46 or the like by the P-CON 44 to control the entire liquid droplet discharging apparatus 10. For example, the CPU 41 controls the liquid droplet discharging heads 50, the workpiece moving mechanism 20 and the head moving mechanism 30 to arrange such that the liquid droplet discharging heads 50 and the workpiece W are opposed to each other. Thereby, in synch with a relative movement between the liquid droplet discharging heads 50 and the workpiece W, the CPU 41 allows the nozzles 52 of each liquid droplet discharging head 50 to discharge liquid as liquid droplets so as to perform drawing operations. In this case, discharging the liquid in synch with the movement of the workpiece W in the X-axis direction is referred to as main scanning, whereas moving the head unit 9 with the liquid droplet discharging heads 50 in the Y-axis direction is referred to as sub scanning. The liquid droplet discharging apparatus 10 of the present embodiment allows discharging and drawing of the liquid through a plurality of times of repetition of combined main scanning and sub scanning. The main scanning is not restricted to the movement of the workpiece W in a single direction relative to the liquid droplet discharging heads 50. It may also be performed by reciprocating the workpiece W.

Examples of the advantageous effects of the above first embodiment are as follows:

1. In the head unit 9 of the first embodiment, the two liquid droplet discharging heads 50 (for example, the heads R1, R2)

discharging the same kind of liquid are arranged in such a manner that the nozzle sequences 52*a* of the two nozzle groups are arranged with a single (common) nozzle pitch therebetween when viewed from the main scanning direction so as to be continuous in the sub scanning direction. Accordingly, the same kind of liquid can be discharged/drawn with the drawing width $L_1$, which is twice the width $L_0$ that the single liquid droplet discharging head 50 is capable to discharge/draw. Furthermore, the heads G1, G2 and the heads B1, B2, which can discharge different kinds of liquids, are also juxtaposed in the main scanning direction. In short, the three different kinds of liquids can be discharged/drawn with the drawing width $L_1$.

2. In the head unit 9 of the first embodiment, the nozzle sequences 52*a* of the two nozzle groups that are continuous in the sub scanning direction when viewed from the main scanning direction have an inclination of the discharging amount distribution. Thus, the liquid droplet discharging heads 50 are arranged in such a manner that the above inclinations are approximately axisymmetrical about the boundary of the two continuing nozzle sequences 52*a* as the axis of symmetry. Consequently, the amount of discharge varies moderately at the boundary between the continuing nozzle sequences 52*a*, thereby causing the variation of the discharge amount in each liquid droplet discharging head 50 to be less noticeable.

3. Since the liquid droplet discharging apparatus 10 of the first embodiment includes the above head unit 9, the variation of the discharge amount in each liquid droplet discharging head 50 is less noticeable, so that the uneven distribution of liquid discharged on the workpiece W can be reduced at the time of discharging the three different kinds of liquids to perform a drawing operation.

Second Embodiment

Method for Discharging Liquid

Next will be described a method for discharging liquid according to a second embodiment using the liquid droplet discharging apparatus 10 of the first embodiment with reference to FIG. 6 to FIG. 9. FIGS. 6 to 9, respectively, show a relationship between an arrangement of the liquid droplet discharging heads and the amount of discharging in a liquid discharging method of each of examples 1 to 4, respectively. In each of the drawings, the length of a longitudinal side of a quadrangle representing each of liquid droplet discharging heads 1, 2 indicates the drawing width $L_0$. The shown discharging amounts each indicate the amount of liquid discharged in the same drawing region by each of the liquid droplet discharging heads 1, 2 during four main scanning operations (pass) performed by moving the workpiece W in the main scanning direction relative to the liquid droplet discharging heads 1, 2. The liquid droplet discharging heads 1, 2 each correspond to the liquid droplet discharging head 50 of the first embodiment, and for example, they may be the heads R1, R2 discharging the same kind of liquid, which are arranged in the head unit 9. Additionally, each of the liquid droplet discharging heads 1, 2 has an inclination of the discharging amount distribution of the nozzle sequence 52*a* as each nozzle group. The inclinations were digitized and thereby it was assumed that the liquid droplet discharging head 1 has a variation of the discharging amount ranging from 1.01 to 1.04, whereas the liquid droplet discharging head 2 has an approximately axisymmetrical inclination (ranging from 1.04 to 1.01) about the axis that is the boundary between the two continuing nozzle sequences 52*a* relative to the liquid droplet discharging head 1. The amounts of discharging were digitized by dividing the drawing width $L_0$ into four groups like the number of times of the main scanning and totalizing the amounts of liquid discharged during every main scanning operation. Thus, substantially, it results in that the nozzle sequence 52*a* as the nozzle group was divided into four groups. In this case, the same drawing region is referred to as a region where liquid was applied from each of the liquid droplet discharging heads 1, 2 by the same number of times as that of the main scanning operations.

The liquid discharging method of the present embodiment includes discharging liquid by performing "n"-number of times (e.g., four times) of main scanning operations on the same drawing region of the workpiece W corresponding to the drawing width $L_0$ of the liquid droplet discharging head 50. Additionally, at the time of the discharging, a sub scanning operation by the head unit 9 is performed in response to each main scanning operation, whereby the arrangement of the liquid droplet discharging heads 50 is changed to discharge liquid.

EXAMPLE 1

Figure 6:
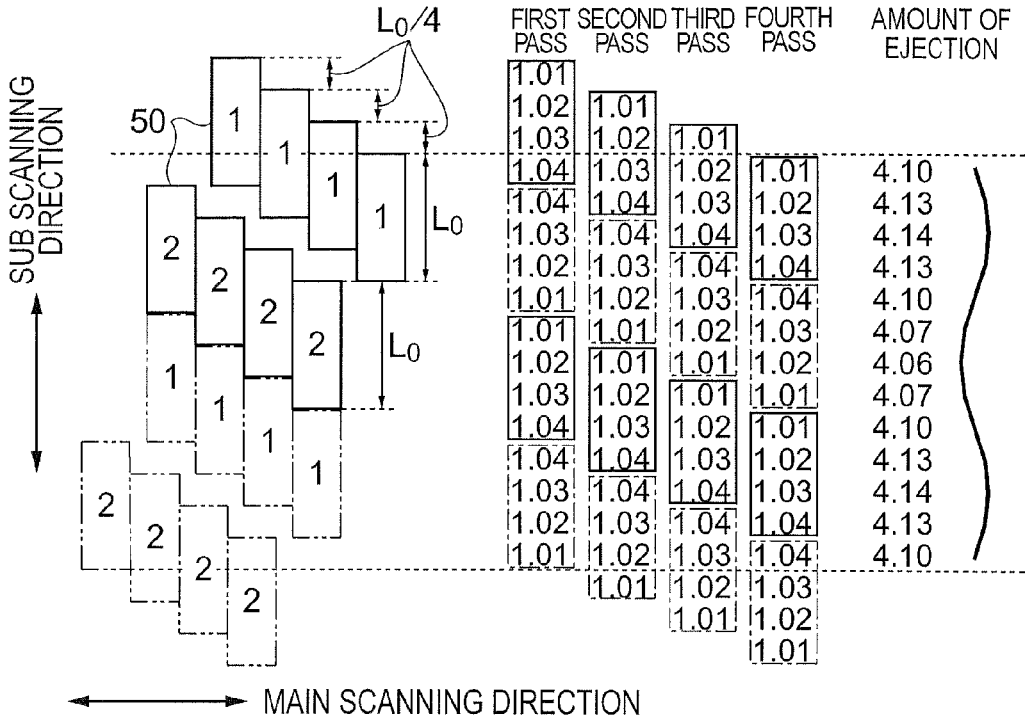
FIG. 6 is a diagram showing a relationship between the arrangement of the liquid droplet discharging heads and the amount of discharging in a liquid discharging method of an example 1 according to a second embodiment.

In FIG. 6, the liquid discharging method of the example 1 includes discharging liquid from each of the liquid droplet discharging heads 1, 2 by four main scanning operations (pass) on the same drawing region of the workpiece W. At the time of the discharging, relative to a prior main scanning operation, the head unit 9 is moved relatively with the workpiece W in such a manner that each of the liquid droplet discharging heads 1, 2 is displaced in the sub scanning direction orthogonal to the main scanning direction by a length of ¼ of the drawing width $L_0$ when viewed from the main scanning direction, thereby performing a subsequent main scanning operation to discharge liquid from each of the discharging heads 1, 2. If the four main scanning operations are not sufficient to allow liquid discharging over the entire drawing region of the workpiece W, a so-called line feeding may be executed in the sub scanning direction to repeat similarly the four main scanning operations (imaginary lines indicate the arrangement of the discharging heads 1, 2). As described above, the drawing width $L_0$ is equivalent to the valid length of the nozzle sequence 52*a*. Thus, each main scanning is performed by displacing the nozzle sequence 52*a* as the nozzle group by ¼ in the sub scanning direction. Furthermore, in this case, the liquid droplet discharging heads 1, 2 included in the head unit 9 are arranged such that the nozzle sequences 52*a* that are adjacent when viewed from the main scanning direction have an approximately axisymmetrical inclination of the discharging amount distribution. Accordingly, the discharging amounts of the adjacent nozzle sequences 52*a* at the boundary therebetween are approximately equal, and the discharging amounts of nozzles at both ends of the adjacent nozzle sequences 52*a* are also approximately equal. Consequently, in the prior and subsequent four main scanning operations, an almost equal amount of liquid is applied at the boundary between the drawing widths $L_0$.

Figure 18A:
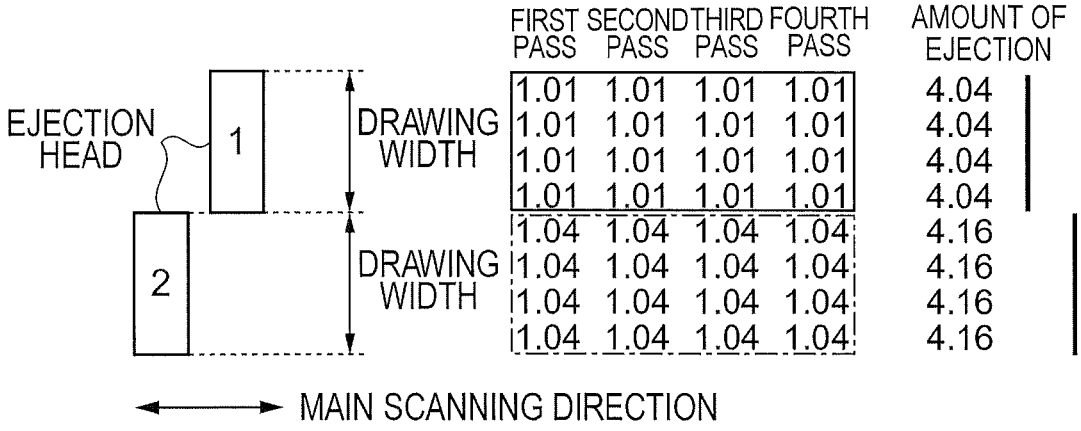
FIG. 18A shows the discharging amount varying among discharging heads in the arrangement of the discharging heads of the related art.
Figure 18B:
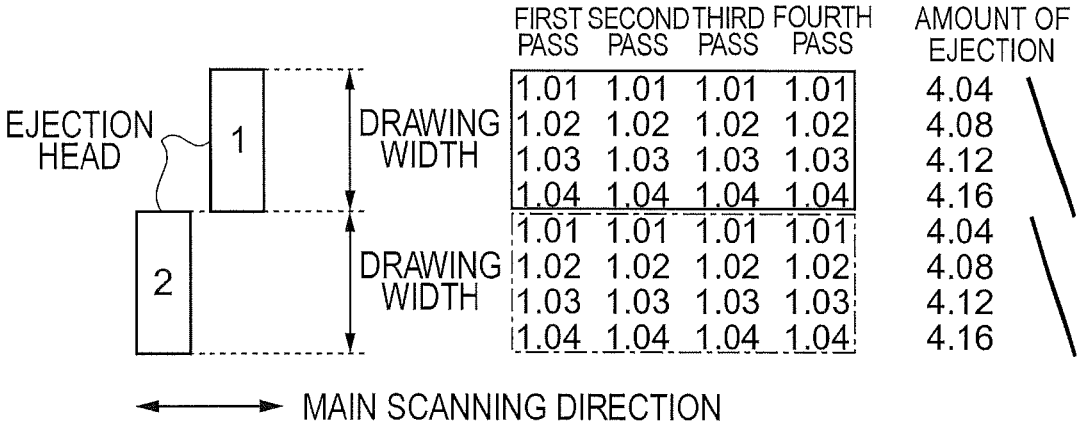
FIG. 18B shows the discharging amount varying among nozzle sequences of the discharging heads in the above arrangement thereof.

As an advantageous effect of the example 1, since each main scanning was performed by displacing the nozzle sequence 52*a* by ¼ in the sub scanning direction, the inclination of the discharging amount distribution of each of the liquid droplet discharging heads 1, 2 could be dispersed over the four main scanning operations. Although the variation of the discharging amount in the known art example shown in FIG. 18B ranges from 4.04 to 4.16, the variation thereof in the example 1 was reduced to a range from 4.06 to 4.14. Additionally, the discharging amount varied moderately at the boundary between the continuing liquid droplet discharging heads 1, 2. Thus, at the boundary therebetween, the uneven distribution of the discharged liquid was less noticeable.

EXAMPLE 2

Figure 7:
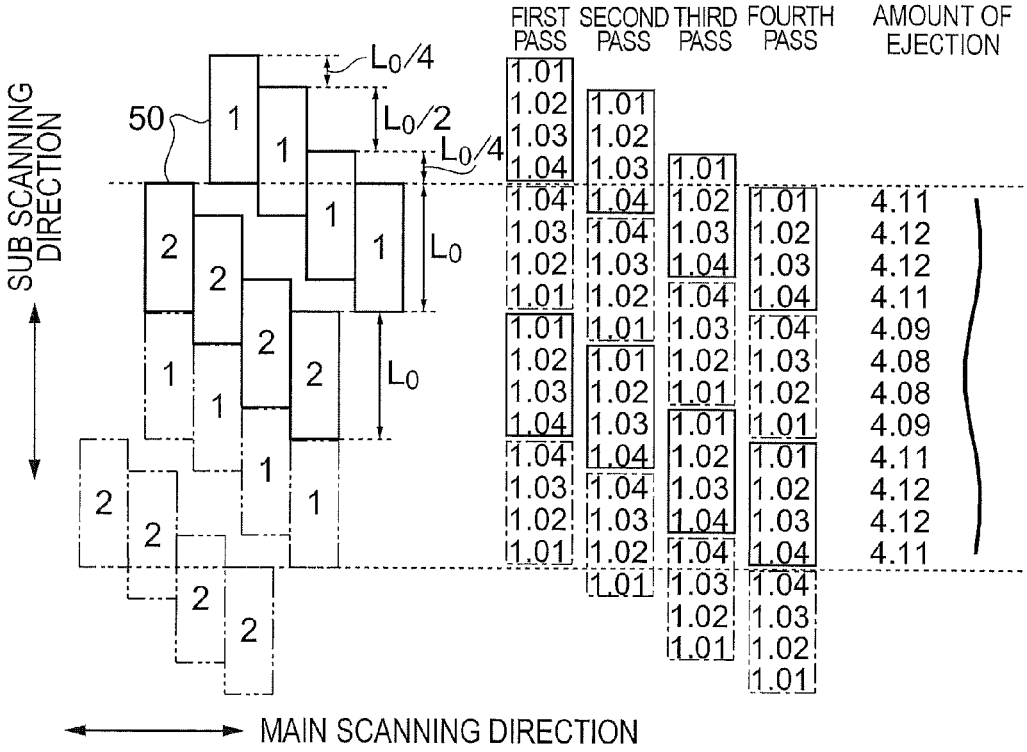
FIG. 7 is a diagram showing a relationship between the arrangement of the liquid droplet discharging heads and the amount of discharging in a liquid discharging method of an example 2 according to a second embodiment.

As shown in FIG. 7, in a liquid discharging method of an example 2, relative to the example 1, liquid is discharged by displacing the liquid droplet discharging heads 1, 2 by a length of ½ of the drawing width $L_0$ in the sub scanning direction at the time of a third main scanning operation. As compared to the example 1, this technique displaces a position of the region for drawing performed by each of the liquid droplet discharging heads 1, 2 arranged such that the inclinations of the discharging amount distributions thereof are approximately axisymmetrical. That is, in the example 2, a phase of the inclination thereof was displaced.

Examples of the advantageous effects of the example 2 are as follows. Changing the displacement amount of the inclination phase at the third main scanning operation from ¼ to ½ could improve the extent to which the positive and negative of the inclinations of the discharging amount distributions of the adjacent nozzle sequences 52*a* are mutually cancelled, so that the variation of the discharging amount resulted in a range from 4.08 to 4.12. Thus, the variation range in the example 2 was decreased as compared to that in the example 1. In addition, the width of a region with a maximum or minimum discharging amount was increased, which showed a gentler variation of the discharging amount. Furthermore, the example 2, without being restricted to the third main scanning, could provide similar advantageous effects even when the displacement amount of the liquid droplet discharging heads 1, 2 (head unit 9) in the sub scanning operation was changed at the time of a second and a fourth main scanning operations.

EXAMPLE 3

Figure 8:
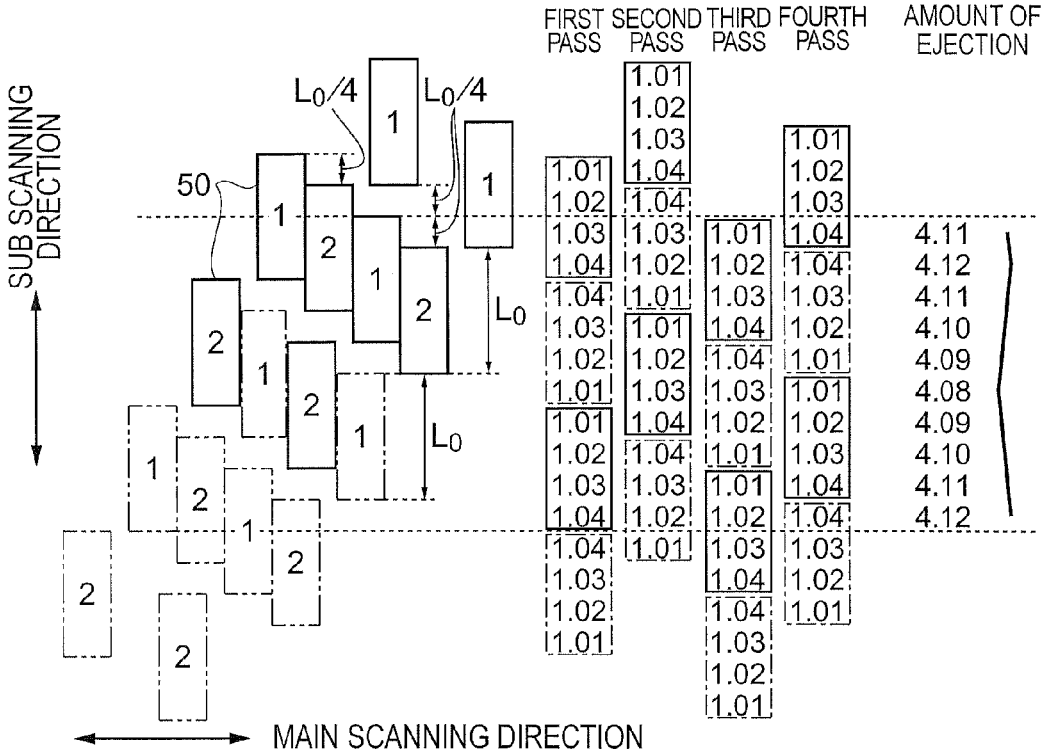
FIG. 8 is a diagram showing a relationship between the arrangement of the liquid droplet discharging heads and the amount of discharging in a liquid discharging method of an example 3 according to the second embodiment.

As shown in FIG. 8, in the liquid discharging method of an example 3, the discharging process was performed as follows. Regarding the two continuing discharging heads 1, 2, relative to the head 1 in a first main scanning operation, the discharging head 2 as the other was displaced in the sub scanning direction by the length of ¼ of the drawing width $L_0$ when viewed from the main scanning direction by moving the head unit 9 relatively with the workpiece W to perform a second main scanning operation. In a third main scanning, relative to the head 2 in the prior main scanning, the head 1 was displaced in the sub scanning direction by the length of ¼ of the drawing width $L_0$. A fourth main scanning was performed by arranging each of the heads 1, 2 in the same manner as in the second main scanning.

One advantageous effect of the example 3 was a reduction of the main scanning in which the same discharging head applies liquid droplets in the same drawing region. Thus, the inclination of the discharging amount distribution in each of the heads 1, 2 can be further dispersed over the four main scanning operations. Specifically, the variation of the discharging amount was gentler than in the example 1. In addition, approximately the same advantageous effect was obtainable as that in the case where the inclination phase of the discharging amount distribution was displaced in the example 2.

EXAMPLE 4

Figure 9:
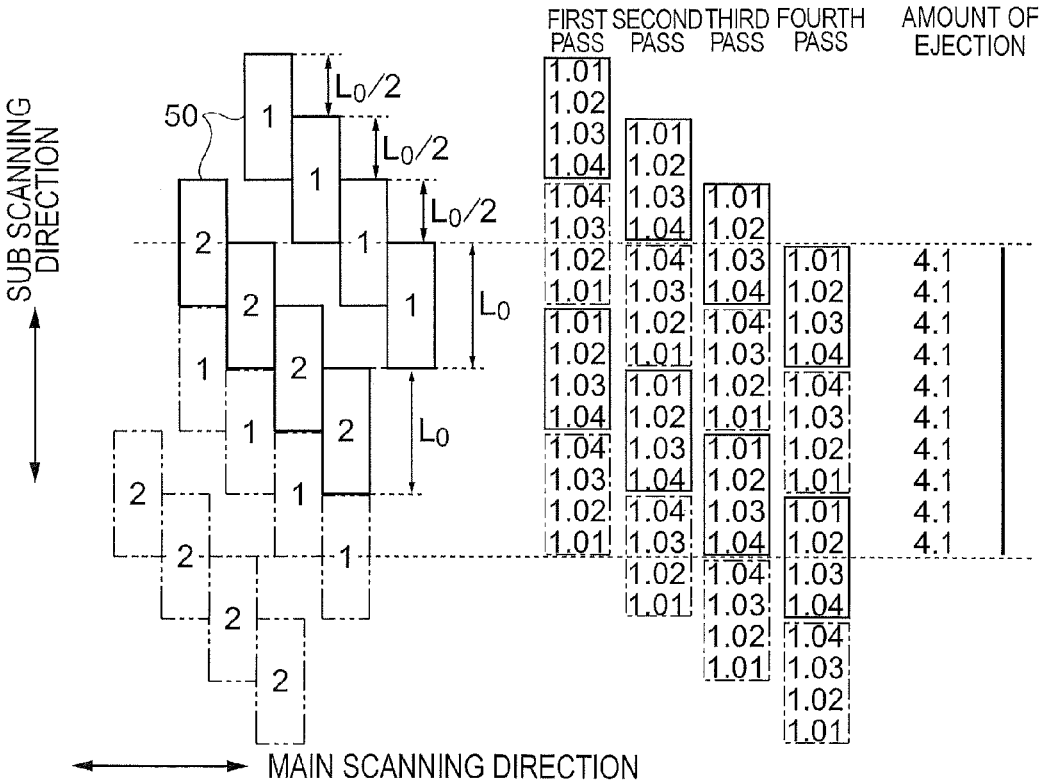
FIG. 9 is a diagram showing a relationship between the arrangement of the liquid droplet discharging heads and the amount of discharging in a liquid droplet discharging method of an example 4 according to the second embodiment.

As shown in FIG. 9, in a liquid discharging method of an example 4, the discharging process was performed as follows. Relative to a prior main scanning operation, a subsequent main scanning operation was performed to discharge liquid droplets from the heads 1, 2 by moving the head unit 9 relatively with the workpiece W in such a manner that each of the heads 1, 2 was displaced in the sub scanning direction by the length of ½ of the drawing width $L_0$ when viewed from the main scanning direction.

The example 4 had the following advantageous effect, for example. In every main scanning after a first main scanning, liquid droplets were applied on the same drawing region by displacing each of the discharging heads 1, 2 by the length of ½ of the drawing width $L_0$ in the sub scanning direction. Thereby, the nozzle sequence 52*a* as the nozzle group having the inclination of the discharging amount distribution were substantially divided into two groups and thus liquid droplets were applied on the same drawing region from a different group of the nozzle sequence 52*a* in every main scanning. In other words, throughout the four main scanning operations, the discharging amount could be equalized by displacing each of the heads 1, 2 by every ½ in the sub scanning direction, thereby allowing liquid to be applied more evenly. Specifically, in the same drawing region, the discharging amount was equalized to 4.1. Furthermore, like the concept of the liquid discharging method of the example 3, in the four main scanning operations, even when a different one of the two discharging heads was alternately displaced by every ¼ in the sub scanning direction to discharge liquid, the same advantageous effects as in the example 4 was obtainable.

Although the present embodiment has described the examples 1 to 4 in which the number of times (n) of main scanning operations was set to four, similar mechanisms and advantageous effects can be obtained if the "n" is a natural number equal to two or greater.

Third Embodiment

Method for Manufacturing Color Filter

Figure 10:
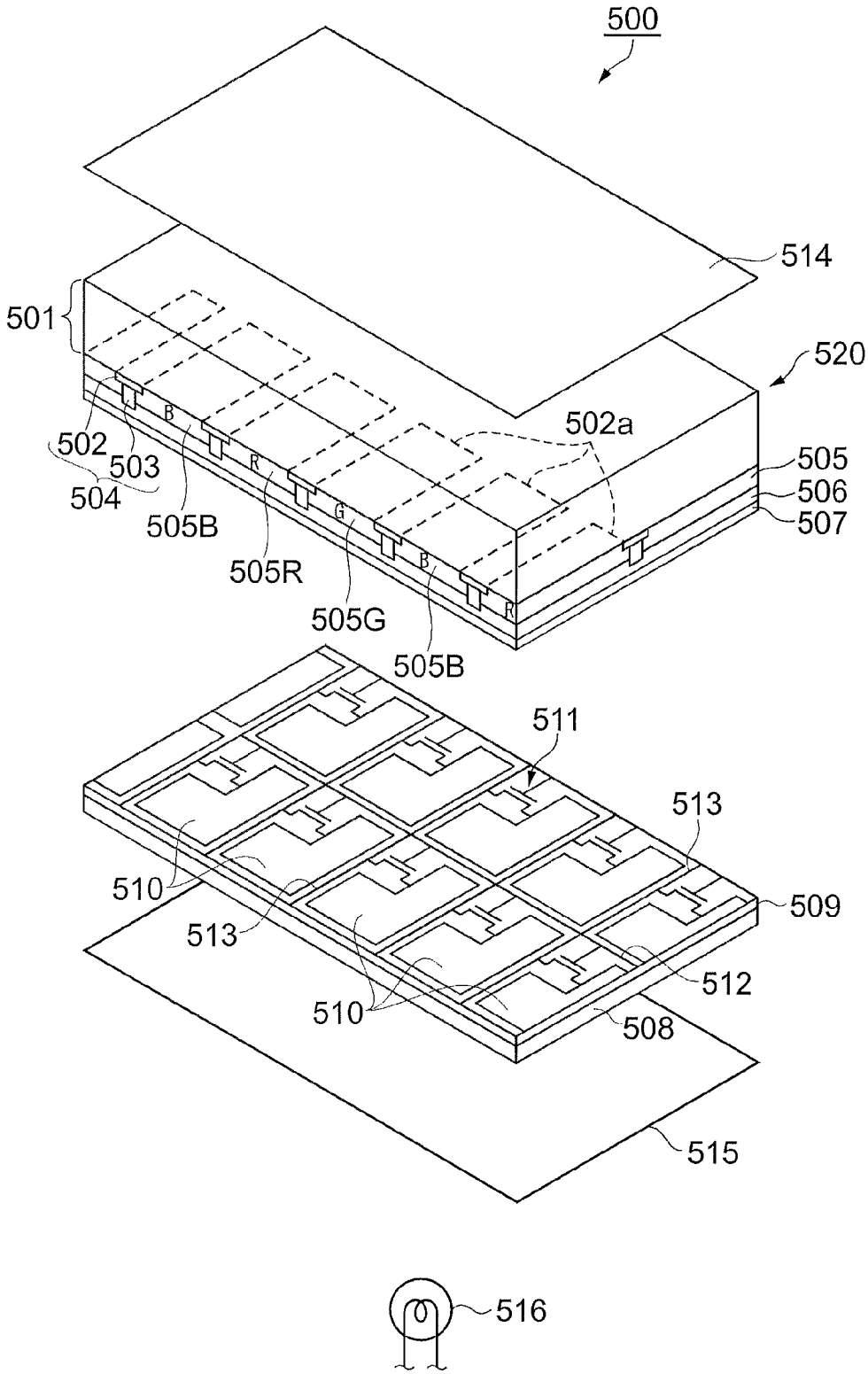
FIG. 10 is a schematic exploded perspective view showing a structure of liquid crystal display.
Figure 11:
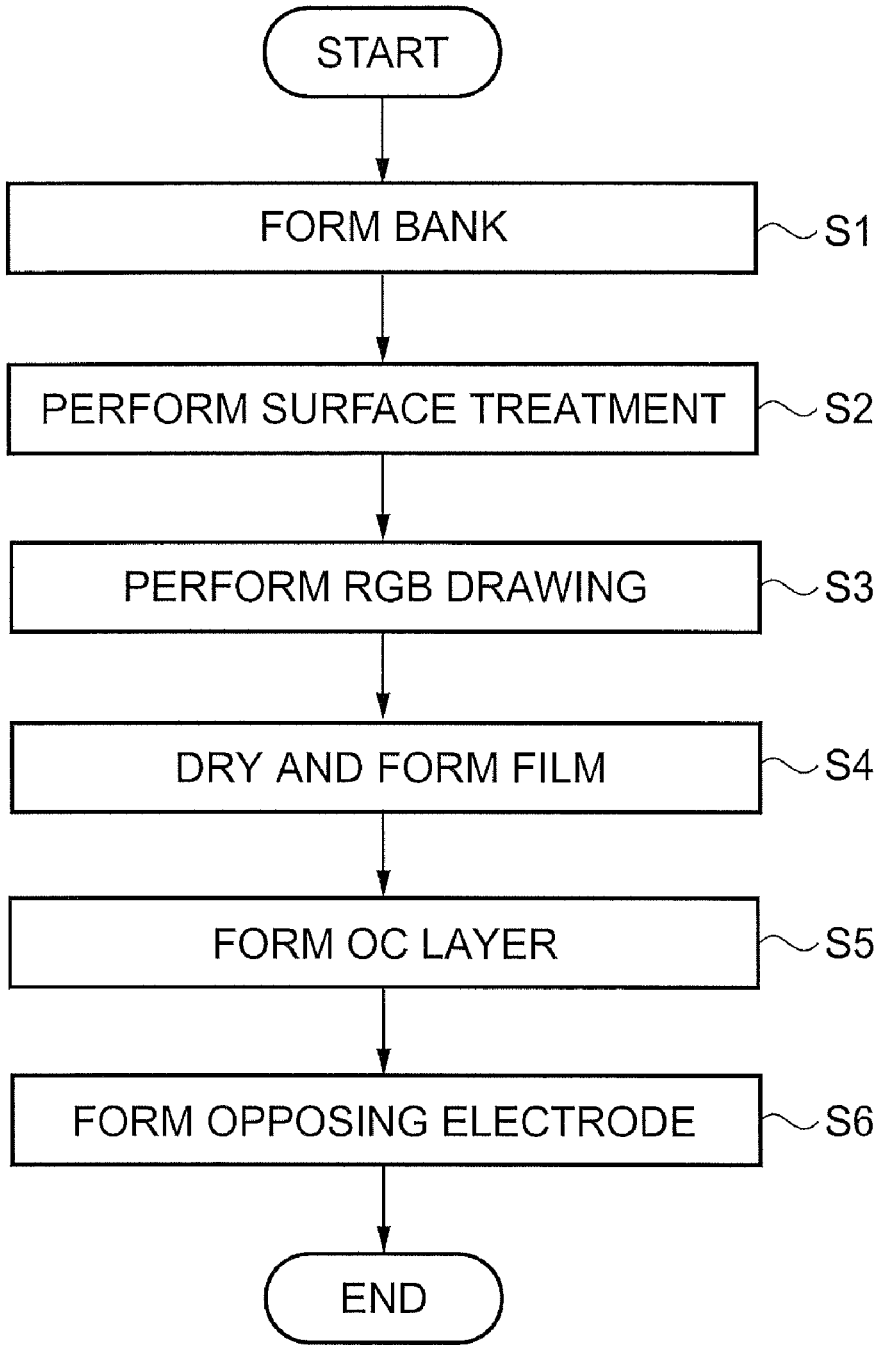
FIG. 11 is a flowchart showing a method for manufacturing a color filter according to a third embodiment of the invention.

Next, by referring to FIG. 10 to FIG. 12E, a description will be given of a method for manufacturing a color filter, which applies the liquid discharging method according to the second embodiment. FIG. 10 is a schematic exploded perspective view showing a structure of a liquid crystal display. FIG. 11 is a flowchart showing the method for manufacturing a color filter. FIGS. 12A to 12E are schematic sectional views showing the method for manufacturing the color filter.

First, a description will be given of the liquid crystal display as an electro-optic device using a color filter. As shown in FIG. 10, a liquid crystal display 500 includes a thin film transistor (TFT) transmissive liquid crystal display panel 520 and an illumination apparatus 516 illuminating the display panel. The liquid crystal display panel 520 includes an opposing substrate 501 having a color filter 505 as a colored layer, an element substrate 508 having a plurality of TFT elements 511 each having three terminals, one of which is connected to each of pixel electrodes 510, and a liquid crystal (not shown) sandwiched by both of the substrates 501 and 508. Additionally, on a surface of each of the substrates 501 and 508 positioned on an outside surface side of the liquid crystal display panel 520, there are disposed an upper polarizing plate 514 and a lower polarizing plate 515 for polarizing a transmitted light.

The opposing substrate 501 is made of a material such as a transparent glass and includes a partition wall portion 504 as a bank for partitioning a plurality of colored regions in a matrix form on a surface side thereof sandwiching the liquid crystal, and color filters 505R, 505G and 505B having three colors of red (R), green (G) and blue (B) as a plurality of colored layers in the partitioned colored regions. The partition wall portion 504 includes a lower layer bank 502, which is referred to as a black matrix made of a lightproof metal such as Cr or an oxide film thereof, and an upper layer bank 503 made of an organic compound formed thereon (downward in the drawing). Additionally, the opposing substrate 501 includes an overcoat layer (OC layer) 506 as a flattening layer that covers the partition wall portion 504 and the color filters 505R, 505G and 505B partitioned thereby, and an opposing electrode 507 made of a transparent conductive film such as indium tin oxide (ITO), which is formed so as to cover the OC layer 506. The color filters 505R, 505G and 505B are manufactured using the method for manufacturing a color filter, which will be described below.

The element substrate 508 is similarly made of a material such as a transparent glass and includes the pixel electrodes 510 formed in a matrix via an insulating film 509 on a main surface side thereof sandwiching the liquid crystal and the TFT elements 511 corresponding to the pixel electrodes 510. Among the three terminals of each TFT element 511, the other two terminals, which are disconnected to the pixel electrodes 510, are respectively connected to each of scan lines 512 and data lines 513, which are arranged in a lattice form so as to surround each pixel electrode 510 while being insulated from each other.

In the illumination apparatus 516, a light source may be a white LED, an EL device, a cold cathode tube or the like. Any light source may be used only if it includes a light guide plate, a diffusion plate, a reflection plate or the like allowing light from the light source to be output to the liquid crystal display panel 520

On each of surfaces of the opposing substrate 501 and the element substrate 508 sandwiching the liquid crystal therebetween, there is formed an alignment film for aligning liquid crystal molecules in a single direction, although not shown in the drawing. In addition, the upper and lower polarizing plates 514, 515 may be combined with an optically functional film such as a phase difference film used to improve visual dependency or the like. The liquid crystal display panel 520 may include a thin film diode (TFD) element as an active element, which is not restricted to a TFT element. Furthermore, only if a color filter can be provided on at least one of the both substrates, a passive liquid crystal display may be used in which pixel electrodes are arranged to intersect with each other.

As shown in FIG. 11, a method for manufacturing the color filter 505 according to the present embodiment includes forming the partition wall portion 504 on a surface of the opposing substrate 501 and performing surface-treatment of the colored regions partitioned by the partition wall portion 504. The method further includes discharging/drawing, as liquid droplets, three kinds (three colors) of liquids including a colored-layer forming material on colored regions where surface treatments have been done by the liquid droplet discharging apparatus 10 of the first embodiment and the step (S4) of drying the drawn liquids to form a film as the color filter 505. The method still furthermore includes forming the OC layer 506 to cover the partition wall portion 504 and the color filter 505 and forming the transparent opposing electrode 507 made of ITO to cover the OC layer 506.

Figure 12A:
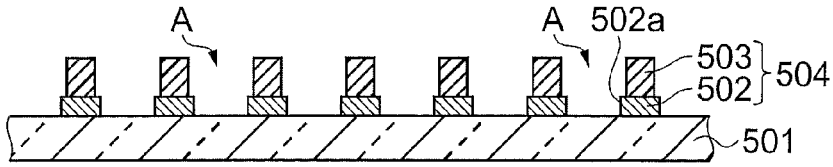
FIGS. 12A to 12E are schematic sectional view showing a method for manufacturing the color filter.

A step S1 in FIG. 11 is formation of the partition wall portion 504. At the step S1, as shown in FIG. 12A, first, the lower layer bank 502 as the black matrix is formed on the opposing substrate 501. The lower layer bank 502 may be made of an opaque metal such as Cr, Ni or Al, or a compound such as an oxide of any thereof, for example. In order to form the lower layer bank 502, a film made of any one of the above materials is formed on the opposing substrate 501 by, for example, vapor deposition or sputtering. A thickness of the film may be determined according to a selected material so as to maintaining lightproofness. For example, if it is made of Cr, a preferable film thickness ranges from 100 to 200 nm. Then, using photolithography, the film of the remaining region excluding a portion corresponding to each opening portion 502*a* (See FIG. 10) is coated with a resist and then etched with an etching solution, such as an acid, in accordance with the above material. Thereby, the lower layer bank 502 with the opening portion 502*a* can be formed.

Next, the upper layer bank 503 will be formed on the lower layer bank 502. As a material of the upper layer bank 503, there may be used an acrylic photosensitive resin. Preferably, the photosensitive resin is a lightproof material. In order to form the upper layer bank 503, for example, the photosensitive resin material is applied on a surface of the opposing substrate 501 with the lower layer bank 502 formed thereon by roll coating or sputtering. Next, by drying the applied material, there can be formed a photosensitive resin layer having a thickness of approximately 2 μm. Next, a mask having an opening portion open with a size corresponding to that of each colored region A is opposed to the opposing substrate 501 at a predetermined position. Then, through exposure and development, the upper layer bank 503 is formed. Thereby, the partition wall portion 504 is also formed to partition the colored regions A in a matrix form on the opposing substrate 501. Described next will be a step S2.

The step S2 in FIG. 11 is to perform surface treatment. The second step S2 employs a plasma treatment using $O_2$ as a treatment gas and a plasma treatment using a fluoric gas as a treatment gas. That is, the colored regions A are subjected to lyophilic treatment and thereafter, the surface (including a wall surface) of the upper layer bank 503 made of the photosensitive resin is subjected to lyophobic treatment. Then, next will be a step S3.

Figure 12B:
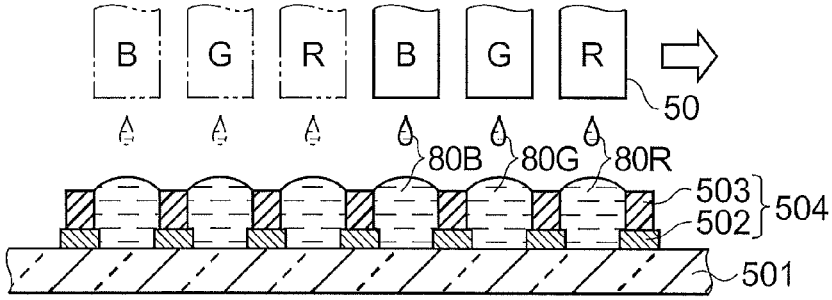

The step S3 is to perform the drawing of the color filter 505 as each colored layer. At the step S3, as shown in FIG. 12B, on each of the colored regions A subjected to the surface treatment, corresponding liquid 80R, 80G or 80B is applied to draw the color filter 505. The liquid 80R includes an R (red)-colored layer formation material; the liquid 80G includes a G (green)-colored layer formation material; and the liquid 80B includes a B (blue)-colored layer formation material. In order to apply each of the liquids 80R, 80G and 80B, by using the liquid droplet discharging apparatus 10 of the first embodiment, each of the liquids 80R, 80G and 80B are filled in the liquid droplet discharging heads 50 to be landed as liquid droplets in each of the colored regions A. Each of the liquids 80R, 80G and 80B is applied by an amount required according to the areas of the colored regions A. The material applied is wettingly spread in each colored region A and raised by surface tension. At the step S3, the liquid discharging method of the second embodiment is performed using the liquid droplet discharging apparatus 10 that can discharge the three different kinds of liquids 80R, 80G and 80B. Accordingly, while reducing uneven liquid distribution, the three kinds of liquids can be discharged on the colored regions A. Next will be a step S4.

Figure 12C:
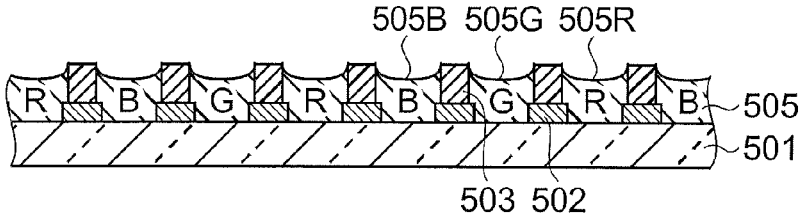

The step S4 in FIG. 11 is to dry the discharged/drawn liquids 80R, 80G and 80B to form a film of each of the color filters 505R, 505G and 505B. At the step S4, as shown in FIG. 12C, the discharged/drawn liquids 80R, 80G and 80B are dried all together to remove a solvent, thereby forming the films of the color filters 505R, 505G and 505B. The drying is preferably performed under reduced pressure, whereby the solvent can be evenly dried off. Then, next will be a step S5.

Figure 12D:
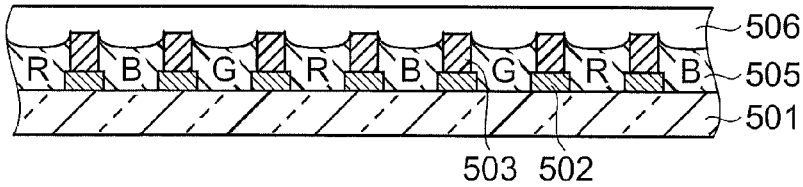

The step S5 shown in FIG. 11 is formation of the OC layer. At the step S5, as shown in FIG. 12D, the OC layer 506 is formed to cover the color filters 505 and the upper layer bank 503. As the material of the OC layer 506, a transparent acryl resin material may be used. For example, the OC layer is formed by spin coating, off-set printing, or the like. The OC layer 506 is disposed to reduce unevenness of the surface of the opposing substrate 501 having the color filters 505 formed thereon to flatten the opposing electrode 507 which will be film-formed on the surface thereof later. Furthermore, for securing adhesion with the opposing electrode 507, a thin film made of $SiO_2$ or the like may be additionally formed on the OC layer 506. Then, next will be a step S6.

Figure 12E:
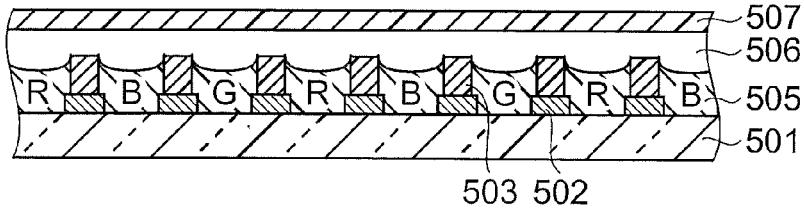

The step S6 in FIG. 11 is formation of the opposing electrode 507. At the step S6, as shown in FIG. 12E, by using sputtering or vapor deposition, there is formed a film made of a transparent electrode material such as ITO or the like in a vacuum air, whereby the opposing electrode 507 is formed on the entire surface of the OC layer 506 in a covering manner.

In the color filters 505 formed on the opposing substrate 501 in the above manner, the variation of the discharging amount of each liquid droplet discharging head 50 is dispersed, thereby reducing the occurrence of uneven colorings due to the uneven distribution of discharged liquid. The opposing substrate 501 and the element substrate 508 having the pixel electrodes 510 and the TFT elements 511 are bonded together at a predetermined position by an adhesive and liquid crystal is filled between both substrates. As a result, the liquid crystal display 500 can be obtained that has less color variations or the like and a high visual display quality.

Advantageous effects of the third embodiment include the following:

1. In the method for manufacturing the color filters 505, at the time of the drawing, by using the liquid discharging method of the second embodiment, the three kinds of liquids 80R, 80G and 80B are discharged in the colored regions A of the opposing substrate 501 to draw the color filters 505R, 505G and 505B as the three kinds of colored layers. Accordingly, the variation of the discharging amount of each liquid droplet discharging head 50 is dispersed, which can reduce uneven coloring such as streak variation due to the uneven distribution of liquid discharged from each liquid droplet discharging head 50. Therefore, the opposing substrate 501 with the color filters 505 disposed thereon can be manufactured with a good yield.

2. The liquid crystal display 500 includes the opposing substrate 501 having the color filters 505 obtained by the above manufacturing method. Accordingly, the liquid crystal display 500 can have less color variation or the like due to streak variation and a high visual display quality.

Fourth Embodiment

Next, a description will be given of a method for manufacturing an organic EL element as another embodiment applying the liquid discharging method of the second embodiment.

First, briefly described will be an organic EL display having the organic EL element.

Figure 13:
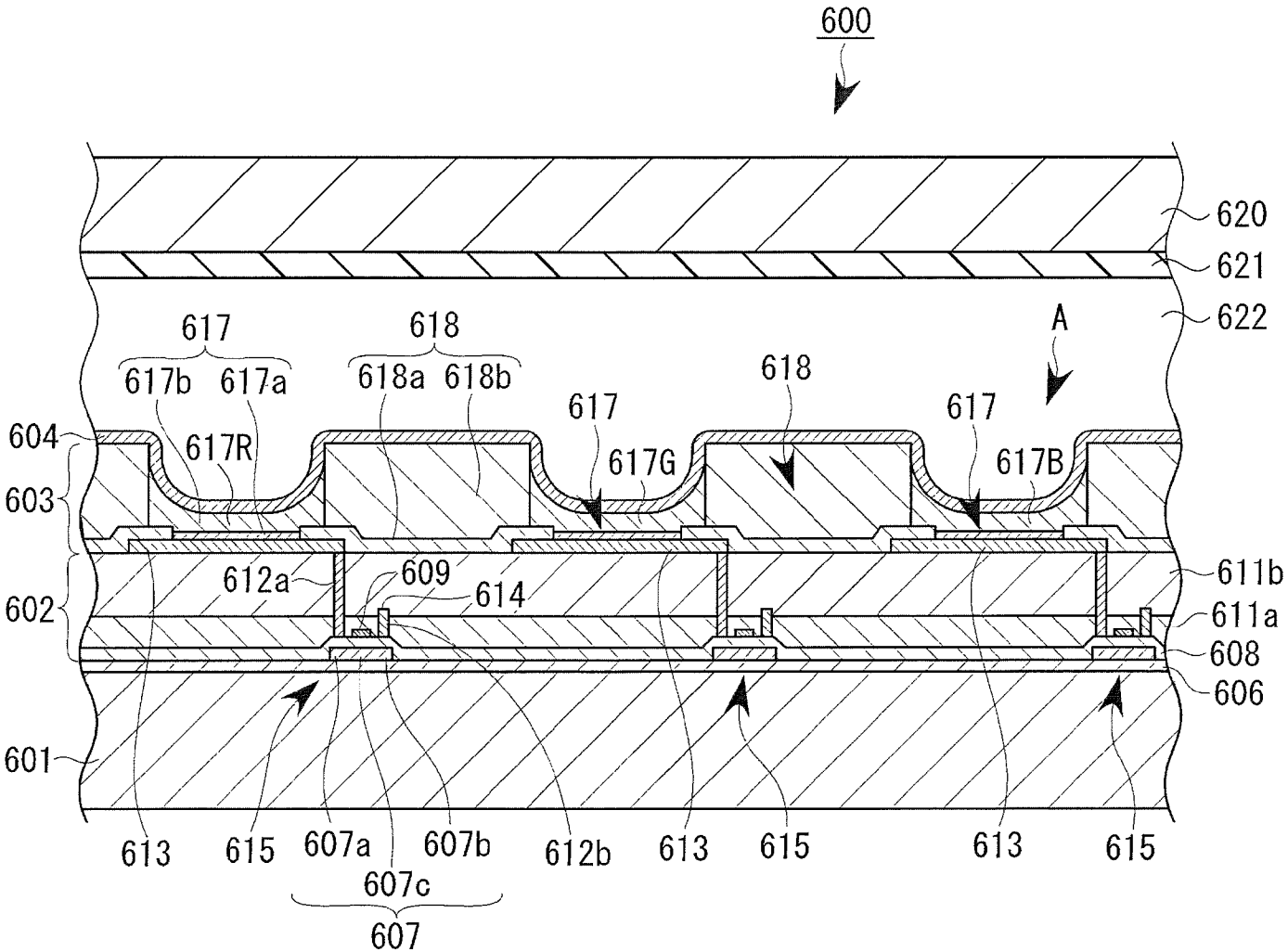
FIG. 13 is a schematic sectional view showing a principal part of an organic EL display according to a fourth embodiment of the invention.

FIG. 13 is a schematic sectional view showing the structure of a principal part of the organic EL display. As shown in FIG. 13, an organic EL display 600 includes an element substrate 601 having a light emitting element section 603 as the organic EL element and a sealing substrate 620 sealingly bonded to the element substrate 601 with a space 622 interposed therebetween. Additionally, the element substrate 601 has a circuit element section 602 disposed thereon. The light emitting element section 603 is formed on the circuit element section 602 in a superimposed manner to be driven by the circuit element section 602. In the light emitting element section 603, three-colored light emitting layers 617R, 617G and 617B as organic EL light emitting layers are formed in their respective light emitting layer formation regions A to be arranged in a striped form. On the element substrate 601, three light emitting layer formation regions A corresponding to three-colored light emitting layers 617R, 617G and 617B are designated as a set of picture elements. The picture elements are arranged in a matrix form on the circuit element section 602 of the element substrate 601. In the organic EL display 600, light emitted from the light emitting element section 603 is output to the element substrate 601.

The sealing substrate 620 is made of glass or metal and bonded to the element substrate 601 with a sealing resin therebetween. On a sealed inside surface thereof is attached a getter agent 621. The getter agent 621 absorbs water or oxygen entering the space 622 between the element substrate 601 and the sealing substrate 620 to protect the light emitting element section 603 from being deteriorated by the entering water or oxygen. However, the getter agent 621 may be omitted.

The element substrate 601 has the light emitting layer formation regions A on the circuit element section 602 and includes partition wall portions 618 partitioning the light emitting layer formation regions A, electrodes 613 formed on the regions A and hole injection/transport layers 617*a* laminated on the electrodes 613. Additionally, the element substrate 601 includes the light emitting element section 603 having the light emitting layers 617R, 617G and 617B formed by applying three kinds of liquids including a light emitting layer formation material inside the light emitting layer formation regions A. Each of the partitioning wall portions 618 includes a lower layer bank 618*a* and an upper layer bank 618*b* substantially partitioning the light emitting layer formation regions A. The lower layer bank 618*a* is disposed jutting out inside each light emitting layer formation region A and made of an inorganic insulating material such as $SiO_2$, thereby preventing electric short circuit caused by direct contact of the electrodes 613 with the light emitting layers 617R, 617G and 617B.

The element substrate 601 is made of a transparent substrate such as glass, for example. On the element substrate 601 is formed an underlying protection film 606 made of a silicon oxide film on which there is formed an island-shaped semiconductor film 607 made of polycrystalline silicon. On the semiconductor film 607 are formed a source region 607*a* and a drain region 607*b* by a phosphorous (P) ion implantation with high concentration. A portion where no P ion has been implanted is referred to as a channel region 607*c*. Additionally, there is formed a transparent gate insulation film 608 covering the underlying protection film 606 and the semiconductor film 607. On the gate insulation film 608 is formed a gate electrode 609 made of Al, Mo, Ta, Ti, W or the like. On the gate electrode 609 and the gate insulation film 608 are formed transparent first and second interlayer insulation films 611*a* and 611*b*. The gate electrode 609 is disposed at a position corresponding to the channel region 607*c* of the semiconductor film 607. Furthermore, there are formed contact holes 612*a* and 612*b*, respectively, penetrating through the first and the second interlayer insulation films 611*a* and 611*b*, respectively, to be connected to the source region 607*a* and the drain region 607*b*, respectively, of the semiconductor film 607. On the second interlayer insulation film 611*b* is arranged the transparent electrode 613 made of ITO, which are patterned into a predetermined shape (electrode formation step). The contact hole 612*a* is connected to the electrode 613, whereas the other contact hole 612*b* is connected to a power supply line 614. In this manner, in the circuit element section 602, there is formed a driving thin film transistor 615 connected to each electrode 613. Furthermore, the section includes a retaining capacitance and a switching thin film transistor, although not shown in FIG. 13.

The light emitting element section 603 includes the electrodes 613 as anodes, hole injection/transport layers 617*a*, the light emitting layers 617R, 617G and 617B (generally referred to as light emitting layers 617*b*), which are sequentially laminated on the electrodes 613, and a cathode 604 laminated to cover the upper layer bank 618*b* and the light emitting layer 617*b*. The hole injection/transport layer 617*a* and the light emitting layers 617*b* are included in a function layer 617 exciting light emission. Using a transparent material to form the cathode 604, the sealing substrate 620 and the getter agent 621 allows an emitted light to be output from the sealing substrate 620 side.

The organic EL display 600 has a scan line (not shown) connected to the gate electrode 609 and a signal line (not shown) connected to the source region 607*a*. When the switching thin film transistor (not shown) is turned on by a scan signal sent to the scan line, a potential of the signal line at that time is retained by the retaining capacitance. Then, according to the state of the retaining capacitance, the driving thin film transistor 615 is turned on or off. Then, electric current flows from the power supply line 614 to the electrode 613 via the channel region 607*c* of the driving thin film transistor 615, and then, flows into the cathode 604 via the hole injection/transport layer 617*a* and the light emitting layer 617*b*. The light emitting layer 617*b* emits light according to the amount of electric current flowing thereinto. The organic EL display 600 allows intended characters, images or the like to be displayed through such a light emitting mechanism of the light emitting element section 603. In addition, the light emitting layer 617*b* is formed by drawing by the liquid discharging method using the liquid droplet discharging apparatus 10. Thus, the display has a high display quality with reduced display defects such as variations of light emission and luminance due to uneven distribution of discharged liquid occurring at a drawing operation.

Method for Manufacturing Organic EL Element

Next, referring to FIGS. 14A to 14F, a description will be given of a method for manufacturing the light emitting element section as the organic EL element according to the present embodiment. FIGS. 14A to 14F are schematic sectional views showing the method for manufacturing the light emitting element section. In the drawings, there is not shown the circuit element section 602 formed on the element substrate 601.

The method for manufacturing the light emitting element section 603 according to the present embodiment includes forming the electrode 613 at a position corresponding to each of the light emitting layer formation regions A on the element substrate 601 and forming a partition wall portion in which the lower layer bank 618*a* is formed such that a part thereof is extended on the electrode 613 with a part thereof and then the upper layer bank 618*b* is formed on the lower layer bank 618*a* so as to substantially partition the light emitting layer formation regions A. Additionally, the above method includes performing a surface treatment of the light emitting layer formation regions A partitioned by the upper layer bank 618*b*, performing discharging/drawing of the hole injection/transport layer 617*a* by applying liquid including a hole injection/transport layer material in each of the surface-treated light emitting layer formation regions A, and drying the discharged liquid to form a film of the hole injection/transport layer 617*a*. The method further includes performing surface treatment of the light emitting layer formation regions A with the hole injection/transport layer 617*a* formed therein, discharging/drawing three kinds of liquids including the light emitting layer formation material in the surface-treated light emitting layer formation regions A, drying the discharged three kinds of liquids to form films of the light emitting layers 617*b* and forming the cathode 604 to cover the upper layer bank 618*b* and the light emitting layer 617*b*. Each liquid is applied in each region A by the liquid discharging method according to the second embodiment. Accordingly, the method applies the arrangement of the liquid droplet discharging heads 50 in the head unit 9 shown in FIG. 3.

Figure 14A:
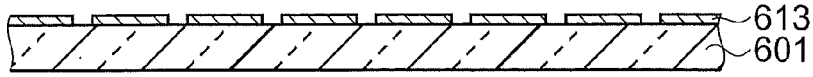
FIGS. 14A to 14F are schematic sectional views showing a method for manufacturing a light emitting element section.

As shown in FIG. 14A, at the time of the electrode (anode) formation, the electrode 613 is formed at the position corresponding to each of the light emitting layer formation regions A on the element substrate 601 where the circuit element section 602 has been formed. As the formation method, for example, on a surface of the element substrate 601, there is formed a transparent electrode film made of a transparent electrode material such as ITO by sputtering or vapor deposition in a vacuum air. Thereafter, while leaving only a necessary part, etching is performed by photolithography to form the electrode 613, which is followed by the process of forming the partition wall portion.

Figure 14B:
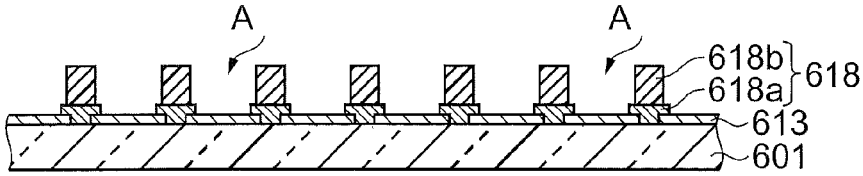

In the partition wall portion formation process, as shown in FIG. 14B, the lower layer bank 618*a* is formed to cover a part of the plurality of electrodes 613 on the element substrate 601. The lower layer bank 618*a* is made of $SiO_2$ (silicon dioxide) as an organic insulation material. In order to form the lower layer bank 618*a*, for example, in accordance with the light emitting layer 617*b*, which will be formed later, masking of the surface of each electrode 613 is performed by using resist or the like. Next, the element substrate 601 subjected to masking is put in a vacuum apparatus to perform sputtering or vacuum deposition using $SiO_2$ as a target or a raw material, thereby forming the lower layer bank 618*a*. The mask made of resist or the like is separated later. Additionally, since the lower layer bank 618*a* is made of $SiO_2$, if the film thickness is equal to 200 nm or less, it has a sufficient transparency. Thus, although the hole injection/transport layer 617*a* and the light emitting layer 617*b* are laminated later, light emission is not inhibited.

Next, the upper layer bank 618*b* is formed on the lower layer bank 618*a* such that each light emitting layer formation region A is substantially partitioned. Preferably, the upper layer bank 618*b* is made of a material that is durable against the solvents of three kinds of liquids 100R, 100G and 100B including the light emitting layer formation material which will be described later. More preferably, there may be mentioned a material which can be made lyophobic by plasma treatment using a fluoric gas as a treatment gas, for example, an organic material such as an acryl resin, an epoxy resin or a photosensitive polyimide. In terms of the formation of the upper layer bank 618*b*, for example, the above photosensitive organic material is applied by roll coating or spin coating on a surface of the element substrate 601 where the lower layer bank 618*a* has been formed and is dried to form a photosensitive resin layer with a thickness of approximately 2 μm. Then, a mask having an opening portion with a size corresponding to that of each light emitting layer formation region A is opposed to the element substrate 601 at a predetermined position. Then, through exposure and development processes, the upper layer bank 618*b* is formed. This also results in the formation of the partition wall portion 618 having the lower layer bank 618*a* and the upper layer bank 618*b*. Next will be the surface treatment process.

At the process of performing the surface treatment of the light emitting layer formation regions A, first, the surface of the element substrate 601 with the partition wall portion 618 formed thereon is treated by plasma using an $O_2$ gas as the treatment gas. Thereby, the surface of the electrode 613, the jutted portion of the lower layer bank 618*a* and the surface (including the wall surface) of the upper layer bank 618*b* are activated to be subjected to lyophilic treatment. Next, plasma treatment is performed thereon by using a fluoric gas such as $CF_4$ as the treatment gas. Thereby, the fluoric gas reacts only with the surface of the upper layer bank 618*b* made of the photosensitive resin as the organic material, which thus results in lyophobic treatment of the surface. Then, next described will be the hole injection/transport layer formation process.

Figure 14C:
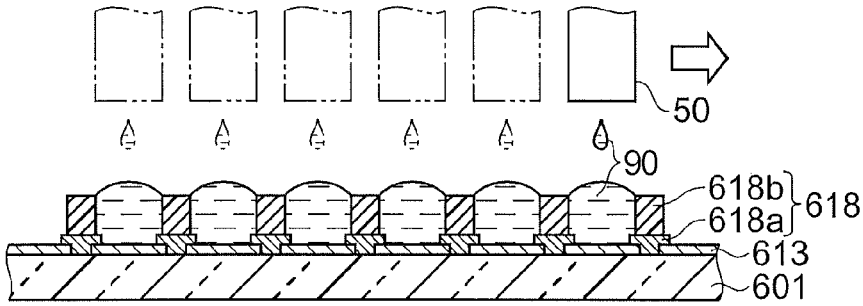

At the hole injection/transport layer formation process, as shown in FIG. 14C, a liquid 90 including a hole injection/transport layer formation material is applied on each light emitting layer formation region A. A method for applying the liquid 90 uses the liquid droplet discharging apparatus 10 with the head unit 9 shown in FIG. 3. The liquid 90 discharged from each of the liquid droplet discharging heads 50 is landed as a liquid droplet on the electrode 613 of the element substrate 601 and spreads to wet the surface. The liquid 90 in an amount necessary according to the size of each region A is discharged as a liquid droplet to be brought into a state of being raised by surface tension. Next will be the drying and film-forming process.

At the drying and film-forming process, the element substrate 601 is heated, for example, by a method such as lamp annealing to dry and remove a solvent in the liquid 90, whereby the hole injection/transport layer 617*a* is formed in a region partitioned by the lower layer bank 618*a* of the electrode 613. In the present embodiment, the hole injection/transport layer is made of polyethylene dioxy thiophene (PEDOT). In this case, the hole injection/transport layer made of the same material is formed in all of the light emitting layer formation regions A. However, in accordance with the light emitting layer 617*b*, which will be formed later, the hole injection/transport layer 617*a* may be made of a different material in each of the regions A. Next will be the surface treatment process.

At the next process, surface treatment is performed as follows. When the hole injection/transport layer 617*a* is made of the above material, the surface of the layer is lyophobic to the three kinds of liquids 100R, 100G and 100B. Thus, surface treatment at the step is performed to allow at least the inside of the light emitting layer formation regions A to be lyophilic again. For the surface treatment, a solvent used in the three kinds of the liquids 100R, 100G and 100B is applied and dried. The solvent is applied by spraying, spin coating or the like. Next will be the light emitting layer drawing process.

Figure 14D:
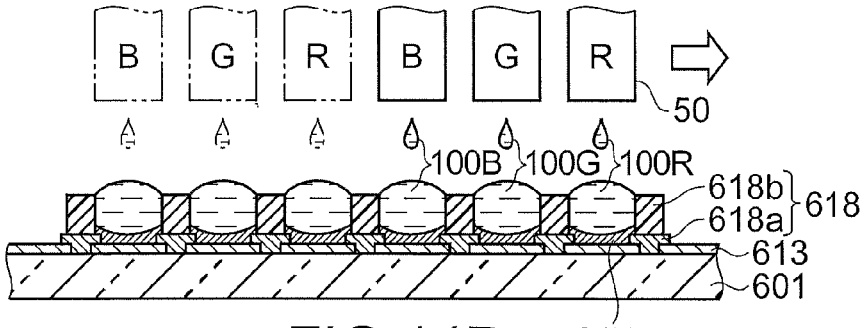

A light emitting layer is drawn in the following manner. As shown in FIG. 14D, using the liquid droplet discharging apparatus 10, the three kinds of the liquids 100R, 100G and 100B including the light emitting layer formation material are applied in the light emitting layer formation regions A from the liquid droplet discharging heads 50. The liquid 100R includes a material for forming the light emitting layer 617R (red); the liquid 100G includes a material for forming the light emitting layer 617G (green); and the liquid 100B includes a material for forming the light emitting layer 617B (blue). Each of the landed liquids 100R, 100G and 100B spreads to wet the surface of each of the light emitting layer formation regions A and a sectional shape of the liquid is raised in an arc. A method for applying the three kinds of liquids uses the liquid discharging method of the second embodiment. Next will be the drying and film-forming process.

Figure 14E:
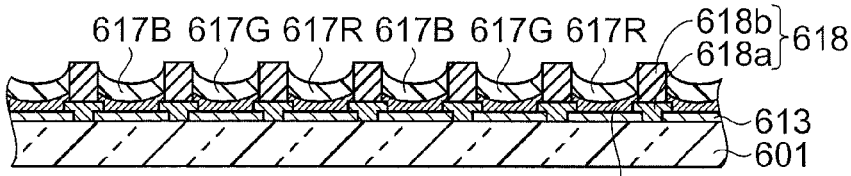

At the process, drying and film-formation is performed as follows. As shown in FIG. 14E, after drying the discharged/drawn liquids 100R, 100G and 100B and removing the solvent therefrom, film formation is performed such that each of the light emitting layers 617R, 617G and 617B is laminated on the hole injection/transport layer 617*a* of each light emitting layer formation region A. In order to dry the element substrate 601 with the liquids 100R, 100G and 100B discharged/drawn, it is preferable to use a treatment of drying under reduced pressure, which allows the evaporation speed of the solvent to be approximately constant. Next will be the cathode formation process.

Figure 14F:
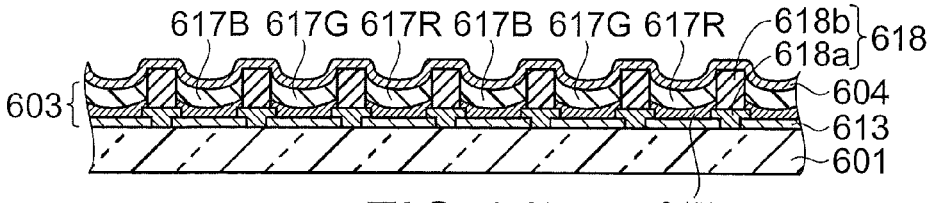

At the cathode formation process, as shown in FIG. 14F, the cathode 604 is formed to cover the light emitting layers 617R, 617G and 617B on the element substrate 601 and the surface of the upper layer bank 618*b*. Preferably, the cathode 604 is made of a combination of metals such as Ca, Ba and Al and a fluoride such as LiF. In particular, preferably, a film made of Ca, Ba or LiF having a small work function is formed on a side near the light emitting layers 617R, 617G and 617B, whereas a film made of Al or the like having a large work function is formed on a side distant therefrom. In addition, a protection layer made of $SiO_2$, SiN or the like may be laminated on the cathode 604. This can prevent oxidization of the cathode 604. The method for forming the cathode 604 may be evaporation, sputtering, chemical vapor deposition (CVD) or the like. Among them, evaporation is preferable, since it can prevent damage due to heat of the light emitting layers 617R, 617G and 617B.

The element substrate 601 formed in the above manner can reduce the uneven distribution of the liquids 100R, 100G and 100B discharged. Accordingly, after the drying and film formation processes, the light emitting layers 617R, 617G and 617B formed thereon can have an approximately even film thickness.

The advantageous effects of the above fourth embodiment include the following:

1. In the method for manufacturing the light emitting element section 603 of the fourth embodiment, at the process of drawing the light emitting layer 617*b*, the liquid discharging method of the second embodiment is used to discharge/draw the liquids 100R, 100G and 100B as liquid droplets in the light emitting layer formation regions A of the element substrate 601. Accordingly, the uneven distribution of discharged liquids occurring at the discharging/drawing process can be reduced. Thus, after the drying and film-forming process, the obtained light emitting layers 617R, 617G and 617B can have an approximately even film thickness.

2. In the organic EL display 600 using the element substrate 601 manufactured by the method according to the fourth embodiment, the light emitting layers 617R, 617G and 617B have the approximately constant film thicknesses. Thus, resistance of each light emitting layer is also approximately constant. Accordingly, when the circuit element section 602 applies a driving voltage to the light emitting element section 603 to allow it to emit light, there can be reduced light emission variation, luminance variation and the like caused by resistance variation in each of the above light emitting layers.

In other words, the organic EL display 600 obtained can have good visual display quality with reduced variations of light emission and luminance due to the uneven distribution of discharged liquids.

Fifth Embodiment

Method for Manufacturing Wiring Substrate

Next, a description will be given of a method for manufacturing a wiring substrate applying the liquid discharging method of the second embodiment described above.

Figure 15:
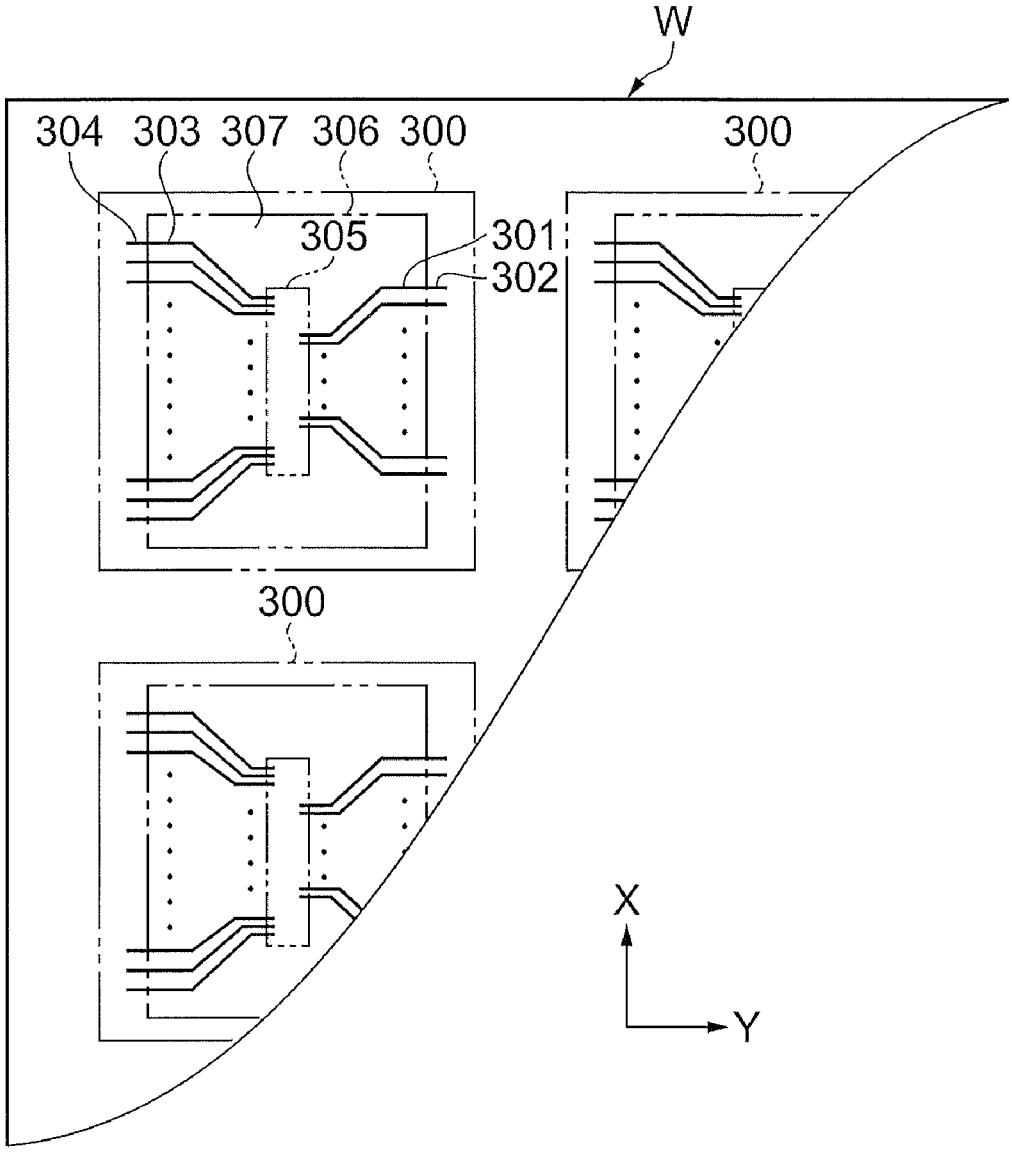
FIG. 15 is a schematic plan view of a wiring substrate according to a fifth embodiment of the invention.

FIG. 15 is a schematic plan view showing the wiring substrate. As shown in the drawing, a wiring substrate 300 is a circuit substrate having a surface-mounted semiconductor device (IC) and includes an input wire 301 and an output wire 303, which are wires made of a conductive material and arranged corresponding to an input/output electrode (bump) of the IC, and an insulation film 307. While avoiding an input terminal portion 302 and an output terminal portion 304, the insulation film 307 covers a plurality of input wires 301 and a plurality of output wires 303 such that the input wires 301 and the output wires 303 are partially exposed inside a mounting region 305. The wiring substrate 300 is formed in a matrix on a substrate W as a workpiece and is obtained by cutting the substrate W. The substrate W may be a glass substrate, a ceramic substrate, a glass epoxy resin substrate, which are rigid as an insulation substrate, or may be a flexible resin substrate. For cutting the substrate W, scribing, dicing, laser cutting, pressing or the like is selected depending on the material of the substrate W.

In the present embodiment, the liquid droplet discharging method using the foregoing liquid droplet discharging apparatus 10 is employed to form the wires made of the conductive material and the insulation film made of the insulating material. The embodiment is intended for the formation of wires and insulation films without material waste. In addition, as compared to photolithography, the method of the embodiment does not require a mask for exposure or a process such as development, etching or the like when forming a pattern. Therefore, the manufacturing process can be simplified regardless of the dimensions of the substrate W.

The method for manufacturing the wiring substrate of the present invention uses the liquid discharging method of the second embodiment. The manufacturing method includes discharging/drawing liquid including a conductive material and drying and burning the discharged/drawn liquid to form the wires 301 and 303. Furthermore, the method also includes discharging liquid including an insulation material on the substrate W with the wires 301 and 303 formed thereon from the liquid droplet discharging heads 50 and drying the discharged liquid to form a film.

At the above drawing process, by using the liquid discharging method of the second embodiment, the liquid including the conductive material is discharged/drawn in accordance with patterns of the wires 301 and 303.

For example, the conductive material in the liquid may be metallic fine particles containing at least any one of gold, silver, copper, aluminum, palladium and nickel, an oxide of any thereof, fine particles of conductive polymer or superconductor, or the like. The conductive fine particles may be used by coating surfaces thereof with an organic substance or the like to improve dispersibility thereof. Preferably, the conductive fine particles have a particle diameter ranging from 1 nm to 1.0 μm. A particle diameter larger than 1.0 μm can cause clogging in the nozzles 52 of the liquid droplet discharging heads 50. In addition, if it is smaller than 1 nm, a volume ratio of the coating agent to the conductive fine particles becomes larger, whereby an excessive amount of an organic substance would be included in an obtained film.

A dispersion medium is not particularly restricted as long as it can disperse the above conductive fine particles and does not cause aggregation. The dispersion medium is, for example, water; an alcohol such as methanol, ethanol, propanol or butanol; a hydrocarbon compound such as n-heptane, n-octane, decane, dodecan, tetradecan, toluene, xylene, cymene, durene, indene, dipentene, tetrahydronaphthalene, decahydronaphthalene or cyclohexyl benzene; an ether compound such as ethyleneglycol dimethyl ether, ethyleneglycol diethyl ether, ethyleneglycol methyl ethyl ether, diethyleneglycol dimethyl ether, diethyleneglycol diethyl ether, diethyleneglycol methyl ethyl ether, 1,2-dimethoxyethane, bis(2-methoxylethyl)ether or p-dioxane; or a polar compound such as proplylene carbonate, γ-butyrolactone, n-methyl-2-pyrrolidone, dimethyl formaldehyde, dimethyl sulfoxide or cyclohexanone. Among them, water, alcohols, hydrocarbon compounds or ether compounds are preferable in view of the dispersibility of the fine particles, the stability of a dispersion, and applicability to the liquid droplet discharging method. More preferably, the dispersion medium is water or any hydrocarbon compound.

Preferably, the dispersion medium of the conductive fine particles has a surface tension ranging from 0.02 N/m or more to 0.07 N/m or less. When liquid is discharged by using the liquid droplet discharging method, if the surface tension thereof is less than 0.02 N/m, wettability of the liquid to a nozzle surface increases, thereby causing flight curving easily. If the surface tension exceeds 0.07 N/m, the shape of a meniscus at a tip of the nozzle 52 is not stabilized, which makes it difficult to control the amount and timing of discharging. Thus, for the adjustment of the surface tension, a small amount of surface-tension adjusting agent such as fluoride, silicide or nonion may be added into the above dispersion in an extent not to significantly reduce a contact angle with the substrate W. The nonionic surface tension adjusting agent helps to increase the wettability of the liquid against the substrate W and improve the leveling property of the film, thereby preventing the occurrence of minute uneveness on the film. The surface tension adjusting agent may include an organic compound such as an alcohol, an ether, an ester or a ketone if necessary.

Preferably, the dispersion has a viscosity ranging from 1 mPa·s or more to 50 mPa·s or less. When discharging the liquid by the liquid discharging method, if the viscosity of the dispersion is less than 1 mPa·s, a peripheral region of the nozzle 52 tends to be spoiled by the liquid flown out. Meanwhile, if the viscosity thereof is more than 50 mPa·s, the occurrence frequency of clogging in the nozzle holes increases, thereby preventing smooth discharging of liquid droplets. Next will be the drying and burning process.

At the drying and burning process, the discharged liquid is hardened by drying and burning to form the wires 301 and 303. Drying and burning may be performed by a batch method in which the substrate W is left in a drying furnace to be dried and burned at a predetermined temperature, or an in-line method allowing the substrate W to pass through the drying furnace. A heat source may be a heater, an infrared lamp, or the like. Next will be the process of discharging the liquid including an insulation material.

At the process thereof, similar to the foregoing drawing process, the liquid discharging method of the second embodiment is employed, whereby the liquid including the insulation material is discharged/drawn on an insulation film formation region 306 (See FIG. 15).

For example, the insulation material may be an insulative high polymer such as an oxy resin or an ethane resin. A solvent used may be a hydrocarbon solvent capable of dissolving the above material. The physical properties of the liquid are adjusted in accordance with the liquid droplet discharging method as in the case of the liquid including the conductive material. Next will be the drying and film-forming process.

At the drying and film-forming process, the discharged liquid is hardened by drying to form the insulation film 307. A photosensitive resin may be used as the insulation material. In this case, the discharged liquid is hardened by irradiating an ultraviolet ray or the like.

Advantageous effects of the fifth embodiment include the following:

1. In the method for manufacturing the wiring substrate 300 according to the fifth embodiment, the liquid discharging method of the second embodiment is used to discharge/draw the liquid including the conductive material and the liquid including the insulation material. Accordingly, uneven liquid distribution can be reduced, thereby stabilizing the film thicknesses of the wires 301, 303 and the insulation film 307. In short, the method according to the fifth embodiment can provide the wiring substrate 300 with stable electrical characteristics (electrical resistance and insulating property).

Hereinabove, some embodiments of the invention have been described. In the foregoing embodiments, however, various modifications can be added within the scope of the invention. For example, the following are modified examples other than the above embodiments.

Modified Example 1

In the head unit 9 of the first embodiment, the arrangement of the liquid droplet discharging heads 50 is not restricted thereto. For example, as long as the nozzle sequences 52*a* are arranged continuously when viewed from the main scanning direction (X-axis direction) with a constant nozzle pitch when viewed from the main scanning direction, the liquid droplet discharging heads 50 may be arranged to intersect with the main scanning direction. In other words, the nozzle sequences 52*a* of the nozzle groups may be arranged in a direction intersecting with the main scanning direction. Thereby, although the drawing width L1 is made smaller, a distance between the nozzles 52 (nozzle pitch) when viewed from the main scanning direction is reduced, so that liquid droplets can be discharged with higher precision in the sub scanning direction (Y-axis direction). Additionally, in this manner, when the nozzle sequences 52*a* are arranged in the direction intersecting with the main scanning direction, in the first to the fourth embodiments using the liquid discharging method of the second embodiment, displacing the nozzle sequences 52*a* in the above intersecting direction to discharge liquid droplets allows the advantageous effects of those embodiments to be obtained.

Modified Example 2

Figure 16A:
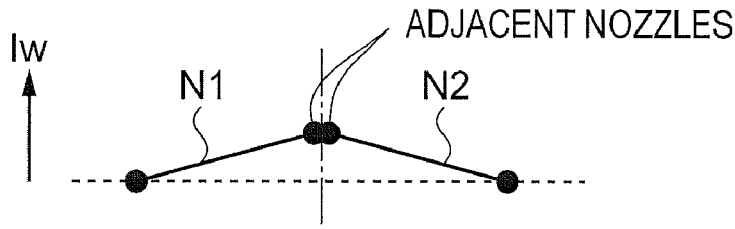
FIGS. 16 A to 16D are pattern diagrams showing an arrangement of a nozzle group in a modified example of the embodiment.
Figure 16B:
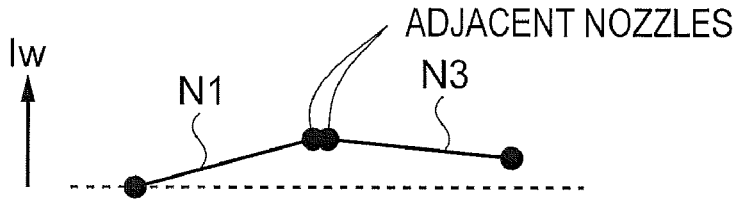
Figure 16C:
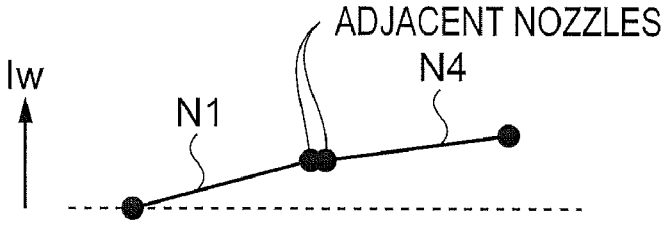
Figure 16D:
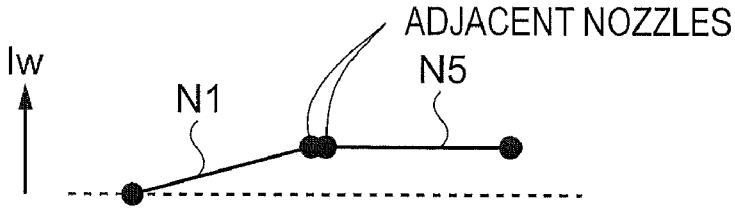

The arrangement of the nozzle sequences 52*a* as the nozzle groups in the head unit 9 of the first embodiment is not restricted thereto. FIGS. 16A to 16D are schematic views showing the arrangement of the nozzle groups according to a modified example 2. As shown in FIG. 16A, in the head unit 9, adjacent nozzle groups N1, N2 are arranged such that the discharging amounts of adjacent nozzles are approximately equal. In addition, the nozzle groups N1, N2 are arranged such that the inclinations of distributions of the discharging amounts are approximately axisymmetrical in the nozzle groups N1, N2 that are adjacent when viewed from the main scanning direction. However, as shown in FIG. 16B, the inclinations thereof are not necessarily axisymmetrical, as long as the inclinations are opposite (positive or negative) to each other. By performing main scanning for discharging liquid after sub scanning by the head unit 9, liquid can be discharged such that the positiveness and negativeness of the inclinations can be mutually cancelled. Furthermore, if the amounts of liquid droplets discharged from the adjacent nozzles are approximately equal, as shown in FIG. 16C or FIG. 16D, the nozzle sequences may be arranged by combining the nozzle group N1 with a nozzle group N4 having a different inclination of the discharging amount distribution or a nozzle group N5 (with an inclination of approximately zero). Still furthermore, the number of the nozzle groups discharging the same kinds of liquids is not restricted to two. For example, when viewed from the main scanning direction, three or more nozzle groups may be arranged continuously in the sub scanning direction. This can reduce the uneven distribution of the same kind of discharged liquid and can further increase the dischargeable drawing width $L_1$.

Modified Example 3

Figure 17A:
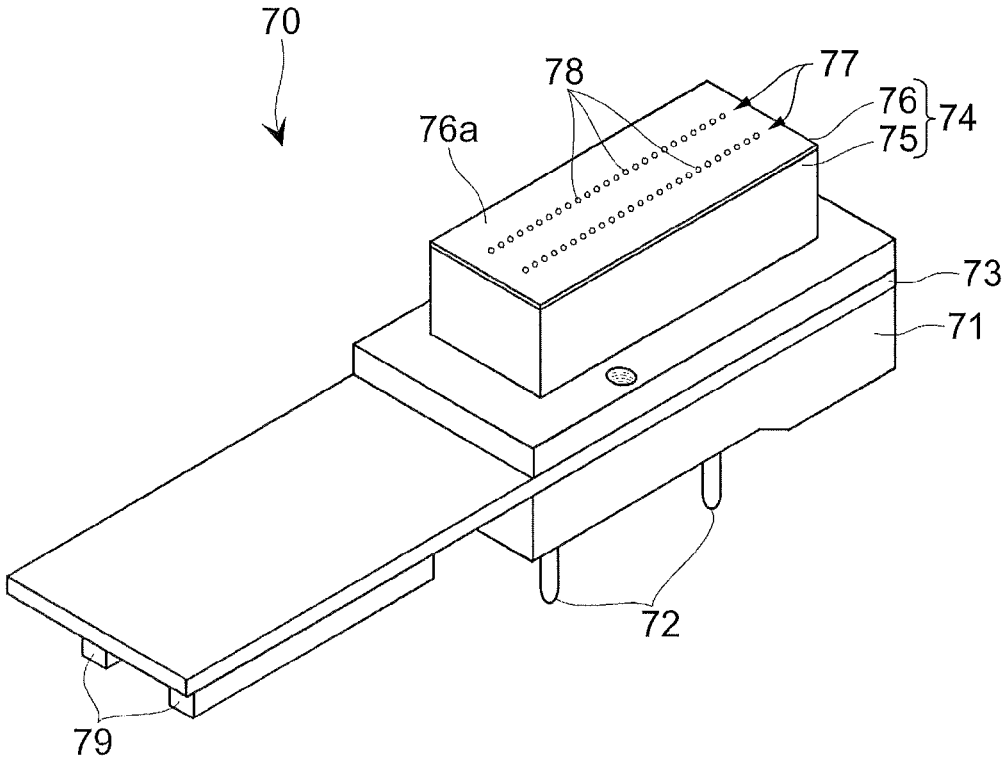
FIGS. 17A and 17B are schematic view showing liquid droplet discharging head according to the modified example of the embodiment.
Figure 17B:
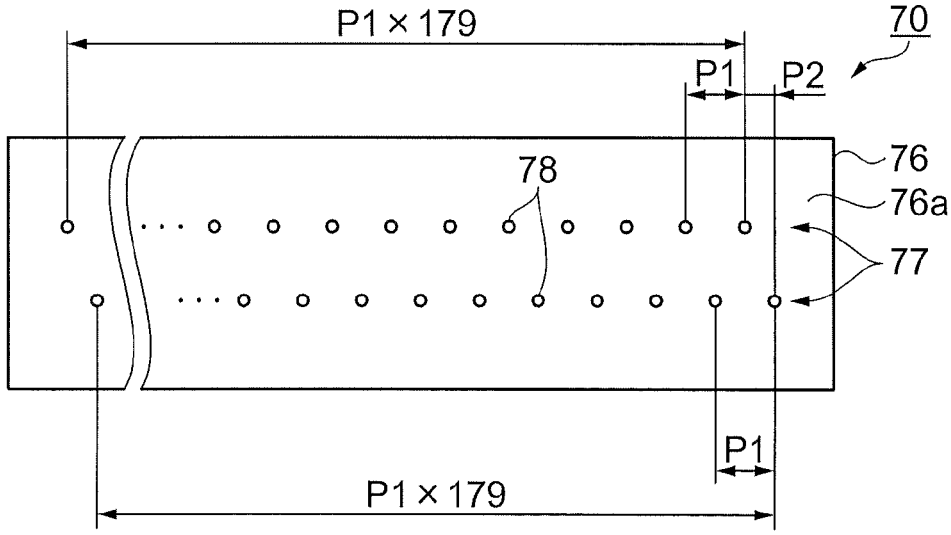

In the head unit 9 of the first embodiment, the nozzle sequence 52*a* as the nozzle group of each liquid droplet discharging head 50 is not restricted to a single sequence. FIGS. 17A and 17B are schematic views showing a liquid droplet discharging head according to a modified example 3. FIG. 17A is a perspective view of the discharging head and FIG. 17B is a plan view of a nozzle plate. For example, as shown in FIG. 17A, a liquid droplet discharging head 70 includes a liquid guiding section 71 having two connection needles 72, a head substrate 73 having a pair of connectors 79, a head main body 74, and a nozzle plate 76 having a plurality of nozzles 78. On a nozzle surface 76*a* of the nozzle plate 76 are formed multiple series (two series) of nozzle sequences 77 as nozzle groups. As shown in FIG. 17B, in the nozzle sequences 77, a plurality of nozzles 78 arranged with a nozzle pitch 1 are formed staggeringly such that the nozzles are displaced from each other by a half nozzle pitch P2. In this manner, the nozzles 78 can be arranged with a narrower pitch in the sub scanning direction when viewed from the main scanning direction. In short, liquid can be discharged with higher precision. The liquid droplet discharging apparatus 10 of the first embodiment includes the rotational mechanism 7 that rotates the carriage 8. Thus, instead of changing the arrangement of the liquid droplet heads 50 in the head unit 9, by rotating the carriage 8, the same advantageous effects can be obtained.

Modified Example 4

In the head unit 9 of the first embodiment, the arrangement of the liquid droplet discharging heads 50 is not restricted thereto. For example, if the discharging heads 50 are arranged so as to reflect the displacement of the discharging heads 1, 2 in the sub scanning direction in the liquid discharging method of the second embodiment, in order to discharge all the same kinds of liquids, the liquid discharges in the examples 1 to 4 can be accomplished with fewer main scanning operations.

Modified Example 5

The features of the head unit 9 of the first embodiment are not restricted to the arrangement of the plurality of liquid droplet discharging heads 50 having the nozzle sequences 52*a* as the nozzle groups. For example, on a common nozzle plate with a plurality of nozzle groups formed thereon, there may be formed nozzles corresponding to each nozzle group. Additionally, a discharging chamber communicating with the nozzles and an energy-generating element applying pressure to liquid filled in the discharging chamber may be individually integrated. In this manner, the nozzle arrangement can be controlled with high precision.

Modified Example 6

In the liquid droplet discharging apparatus 10 of the first embodiment, the features of the sub scanning operation by the head unit 9 are not restricted to that. For example, the head unit 9 may be fixed at a drawing position, whereas the workpiece W may be made movable both in the main scanning direction and in the sub scanning direction. Alternatively, the head unit 9 may be made movable in the main scanning direction, whereas the workpiece W may be made movable in the sub scanning direction.

Modified Example 7

The liquid discharging method of the second embodiment can apply the liquid discharging method of each of the examples 1, 2 and 4, even when the head unit 9 includes only a single liquid droplet discharging head 50.

Modified Example 8

A film pattern forming method, which allows application of the liquid discharging method of the second embodiment, is not restricted to the color filter manufacturing method of the third embodiment, the organic EL element manufacturing method of the fourth embodiment, and the wiring substrate manufacturing method of the fifth embodiment. For example, in the liquid crystal display 500 shown in FIG. 10, the film pattern forming method can be also applied to a method for applying an aligning film aligning liquid crystal particles in a predetermined direction and a liquid crystal material in a predetermined region. In addition, the method can also be applied to a method for forming the hole injection/transport layers 617*a* of the organic EL display 600 in FIG. 13.

Modified Example 9

In the method for manufacturing the wiring substrate 300 according to the fifth embodiment, the wiring substrate 300 is not restricted to a single layer. For example, the manufacturing method can also be applied to a method for manufacturing a multilayered wiring substrate having another wire and another insulation film laminated on the insulation film 307.

Although the present invention has been described in connection with certain embodiments and examples, it will be apparent to those skilled in the art that various modifications and changes may be added thereto without departing from the scope of the invention.

What is claimed is:

1. A head unit, comprising:

a first nozzle group having a plurality of spaced apart first nozzles that discharge liquid as liquid droplets, the first nozzles being uniformly arranged at an approximately equal distance from one another when viewed from a first direction;

a second nozzle group having a plurality of spaced apart second nozzles that discharge liquid as liquid droplets, the second nozzles being uniformly arranged at approximately the same equal distance from one another when viewed from the first direction as the first nozzles;

wherein the first and second nozzle groups are arranged proximate one another, and the first and second nozzle groups are continued with the same equal distance therebetween in a second direction that intersects with the first direction when viewed from the first direction, wherein adjacent nozzles of the first and second nozzle groups when viewed from the first direction discharge liquid droplets having an approximately equal amount of liquid, wherein the first nozzle group has a first inclination of liquid discharge amount from one end of the first nozzles to an opposite end of the first nozzles, wherein the second nozzle group has a second inclination of liquid discharge amount from one end of the second nozzles to an opposite end of the second nozzles, and wherein the first nozzle group is arranged relative to the second nozzle group such that the first inclination is different than the second inclination.

2. The head unit according to claim 1, wherein the first nozzle group is arranged relative to the second nozzle group such that the first inclination is opposite the second inclination.

3. The head unit according to claim 2, wherein the first nozzle group is arranged relative to the second nozzle group such that the first inclination is axisymmetrical relative to the second inclination when viewed from the first direction.

4. The head unit according to claim 1, wherein the first nozzle group is juxtaposed relative to the second nozzle group on the head unit in the first direction.

5. A liquid droplet discharging apparatus, comprising:

a head unit including:

a first nozzle group having a plurality of spaced apart first nozzles that discharge liquid as liquid droplets, the first nozzles being uniformly arranged at an approximately equal distance from one another when viewed from a first direction;

a second nozzle group having a plurality of spaced apart second nozzles that discharge liquid as liquid droplets, the second nozzles being uniformly arranged at approximately the same equal distance from one another when viewed from the first direction as the first nozzles;

wherein the first and second nozzle groups are arranged proximate one another, and the first and second nozzle groups are continued with the same equal distance therebetween in a second direction that intersects with the first direction when viewed from the first direction, and wherein adjacent nozzles of the first and second nozzle groups when viewed from the first direction discharge liquid droplets having an approximately equal amount of liquid;

a workpiece arranged opposite to the head unit and movable relatively with the head unit to perform main scanning, the first and second nozzle groups discharging the liquid as the liquid droplets in synch with the main scanning, wherein the first nozzle group has a first inclination of liquid discharge amount from one end of the first nozzles to an opposite end of the first nozzles, the second nozzle group has a second inclination of liquid discharge amount from one end of the second nozzles to an opposite end of the second nozzles, and the first nozzle group is arranged relative to the second nozzle group such that the first inclination is different than the second inclination.

6. The liquid droplet discharging apparatus according to claim 5, wherein the first nozzle group is arranged on the head unit relative to the second nozzle group such that the first inclination is opposite the second inclination.

7. The liquid droplet discharging apparatus according to claim 6, wherein the first nozzle group is arranged on the head unit relative to the second nozzle group such that the first inclination is axisymmetrical relative to the second inclination when viewed from the main scanning direction.

8. The liquid droplet discharging apparatus according to claim 5, wherein the first nozzle group is juxtaposed relative to the second nozzle group on the head unit in the main scanning direction.

9. A method for discharging liquid, comprising: preparing a head unit including:

a first nozzle group having a plurality of spaced apart first nozzles that discharge liquid as liquid droplets, the first nozzles being uniformly arranged at an approximately equal distance from one another when viewed from a first direction;

a second nozzle group having a plurality of spaced apart second nozzles that discharge liquid as liquid droplets, the second nozzles being uniformly arranged at approximately the same equal distance from one another when viewed from the first direction as the first nozzles;

wherein the first and second nozzle groups are arranged proximate one another, and the first and second nozzle groups are continued with the same equal distance therebetween in a second direction that intersects with the first direction when viewed from the first direction, and wherein adjacent nozzles of the first and second nozzle groups when viewed from the first direction discharge liquid droplets having an approximately equal amount of liquid, arranging a workpiece in a position opposite to the head unit to move relatively with the head unit so as to perform main scanning; and discharging the liquid as the liquid droplets from each of the first and second nozzle groups in synch with the main scanning that is performed n-number of times in the same drawing region of the workpiece, in which, relative to a prior main scanning, a subsequent main scanning is performed by moving the head unit relatively with the workpiece so that the first and second nozzle groups are displaced in the second direction by a length of 1/n of a valid length of the first and second nozzle groups when viewed from the main scanning direction to discharge the liquid droplets therefrom.

10. The method for discharging liquid according to claim 9, wherein, at the time of the discharging, the head unit is moved relatively with the workpiece so that, relative to one of the first and second nozzle groups in a prior main scanning, the other one of the first and second nozzle groups is displaced in the intersecting direction by the length of 1/n of the valid length of the first and second nozzle groups when viewed from the main scanning direction to perform a subsequent main scanning.

11. The method for discharging liquid according to claim 9, wherein, at the time of the discharging, in at least one of the n-number of times of the main scanning operations, the head unit is moved relatively with the workpiece so that, relative to the prior main scanning, each of the first and second nozzle groups is displaced in the intersecting direction by a length of ½ of the valid length of the first and second nozzle groups when viewed from the main scanning direction.

12. The method for discharging liquid according to claim 9, wherein:

the first nozzle group has a first inclination of liquid discharge amount from one end of the first nozzles to an opposite end of the first nozzles;

the second nozzle group has a second inclination of liquid discharge amount from one end of the second nozzles to an opposite end of the second nozzles; and the first nozzle group is arranged relative to the second nozzle group such that the first inclination is different than the second inclination.

13. The method for discharging liquid according to claim 12, wherein the first nozzle group is arranged on the head unit relative to the second nozzle group such that the first inclination is opposite the second inclination.

14. The method for discharging liquid according to claim 12, wherein the first nozzle group is arranged on the head unit relative to the second nozzle group such that the first inclination is axisymmetrical relative to the second inclination when viewed from the main scanning direction.

15. The method for discharging liquid according to claim 9, wherein the first nozzle group is juxtaposed relative to the second nozzle group on the head unit in the main scanning direction.

16. The method for discharging liquid according to claim 9 further comprising:

partitioning and forming a plurality of colored regions on a substrate;

discharging the liquid droplets in the colored regions, the liquid including a colored-layer forming material for at least three colors; and drying the discharged liquids to form colored layers of the at least three colors.

17. The method for discharging liquid according to claim 9 further comprising:

partitioning and forming light-emitting layer formation regions on a substrate;

discharging the liquid droplets in the each region, the liquid including at least a light-emitting layer forming material,; and drying the discharged liquid to form an organic EL light-emitting layer.

18. A method for discharging liquid, comprising:

preparing a head unit including:

a first nozzle group having a plurality of spaced apart first nozzles that discharge liquid as liquid droplets, the first nozzles being uniformly arranged at an approximately equal distance from one another when viewed from a first direction;

a second nozzle group having a plurality of spaced apart second nozzles that discharge liquid as liquid droplets, the second nozzles being uniformly arranged at approximately the same equal distance from one another when viewed from the first direction as the first nozzles;

wherein the first and second nozzle groups are arranged proximate one another, and the first and second nozzle groups are continued with the same equal distance therebetween in a second direction that intersects with the first direction when viewed from the first direction, and wherein adjacent nozzles of the first and second nozzle groups when viewed from the first direction discharge liquid droplets having an approximately equal amount of liquid, arranging a workpiece in a position opposite to the head unit to move relatively with the head unit so as to perform main scanning; and discharging the liquid as the liquid droplets from each of the first and second nozzle groups in synch with the main scanning that is performed n-number of times in the same drawing region of the workpiece, in which, relative to a prior main scanning, a subsequent main scanning is performed by moving the head unit relatively with the workpiece so that the first and second nozzle groups are displaced in the second direction by a length of ½ of a valid length of the first and second nozzle groups when viewed from the main scanning direction to discharge the liquid droplets therefrom.

19. The method for discharging liquid according to claim 18, wherein at the time of the discharging, the head unit is moved relatively with the workpiece so that, relative to one of the first and second nozzle groups in the prior main scanning, the other one of the first and second nozzle groups is displaced in the intersecting direction by the length of ½ of the valid length of the first and second nozzle groups when viewed from the main scanning direction.

* * * * *